US007256814B2

(12) United States Patent
Tsujino et al.

(10) Patent No.: US 7,256,814 B2
(45) Date of Patent: Aug. 14, 2007

(54) IMAGE FORMING APPARATUS AND IMAGE FORMING METHOD

(75) Inventors: Kiyoshi Tsujino, Nagano (JP); Yujiro Nomura, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 195 days.

(21) Appl. No.: 10/914,054

(22) Filed: Aug. 6, 2004

(65) Prior Publication Data

US 2005/0068402 A1 Mar. 31, 2005

(30) Foreign Application Priority Data

Aug. 8, 2003 (JP) ..... P2003-289998
Aug. 8, 2003 (JP) ..... P2003-289999
Aug. 8, 2003 (JP) ..... P2003-290000
Aug. 25, 2003 (JP) ..... P2003-299694
Aug. 26, 2003 (JP) ..... P2003-300831

(51) Int. Cl.
*G03G 15/043* (2006.01)

(52) U.S. Cl. ..... 347/247

(58) Field of Classification Search ..... 347/112, 347/115, 116, 117, 118, 132, 133, 236, 237, 347/246, 247
See application file for complete search history.

(56) References Cited

U.S. PATENT DOCUMENTS 5,430,472 A 7/1995 Curry
5,444,525 A 8/1995 Takahashi et al.
2002/0043611 A1 4/2002 Yoshikawa et al.
2002/0093561 A1 7/2002 Ozaki et al.
2003/0113133 A1 6/2003 Ryuzaki et al.

FOREIGN PATENT DOCUMENTS

| | | |
|---|---|---|
| GB | 2 241 347 | 8/1991 |
| JP | 05-122481 | 5/1993 |
| JP | 06-266175 | 9/1994 |
| JP | 08-248854 | 9/1996 |
| JP | 09-81006 | 3/1997 |
| JP | 09-174922 | 7/1997 |
| JP | 09-191674 | 7/1997 |
| JP | 09-234904 | 9/1997 |
| JP | 10-307506 | 11/1998 |
| JP | 2000-19921 | 1/2000 |
| JP | 2000-89640 | 3/2000 |
| JP | 2000-98802 | 4/2000 |
| JP | 2000-112196 | 4/2000 |
| JP | 2000-352919 | 12/2000 |
| JP | 2003-211725 | 7/2003 |

*Primary Examiner*—Huan Tran
(74) *Attorney, Agent, or Firm*—Hogan & Hartson LLP

(57) ABSTRACT

In an image forming apparatus, an image carrier is configured to rotate in a first direction. An image writer is adapted to irradiate the image carrier to form an electrostatic latent image thereon. A storage stores information regarding a factor disturbing the formation of the latent image in advance. A controller controls the irradiation of the image writer so as to eliminate the disturbing factor, based on the information stored in the storage.

14 Claims, 22 Drawing Sheets

IMAGE FORMING APPARATUS AND IMAGE FORMING METHOD

BACKGROUND OF THE INVENTION

The present invention relates to an image forming apparatus and an image forming method for suppressing the occurrence of the degradation factors of the image quality such as a banding phenomenon occurring in the secondary scanning direction during image formation on an image carrier.

An image forming apparatus comprises a plurality of image formation units, such as an image carrier, an image writer, a charger, a developer, and a transferee. In such an image forming apparatus, the initiation and the termination of each of the operations for rotating the image carrier, charging the image carrier, exposing the image carrier (latent image writing), developing the latent image and transferring a toner image are prescribed as a sequence. Incidentally, vibrations may occur in the apparatus in synchronization with various steps in the sequence. Further, the circumferential speed of the image carrier may fluctuate.

In the case of the image forming apparatus is a monochromatic printer, as shown in FIG. 20, a rotation signal for an image carrier turns ON at time "to". At the same time, a charging signal turns ON. Then, at time "ta", a signal for image writer turns ON, so that exposure operation begins.

After that, at time "tb", an activation signal for a developer turns ON. The activation of the developer indicates such time duration that the developer is performing any operation such as the rotation of a development roller. Then, at time "tc", an activation signal for a transfer roller turns ON, so that transfer operation begins. The transfer operation includes the operation of the transfer roller and the application of a transfer bias. At time "td", the rotation signal for the image carrier turns OFF, so that the transfer operation ends.

In this example, vibrations in the apparatus and a fluctuation in the circumferential speed of the image carrier occur at the timing that the operation of the developer is initiated or terminated. The fluctuation in the circumferential speed of the image carrier is caused by an increase or a decrease in the friction in the image carrier. These increases and decreases are caused by a fluctuation occurring at the above-mentioned timing in an electrostatic force associated with the bias (voltage). In a case where this timing of initiation or termination of the development falls within the duration of the exposure operation as indicated by time "tb", inhomogeneity occurs in the image density at that timing. Further, in case where the transfer signal turns ON during the exposure operation as indicated by time "tc", vibrations occur also at this timing, so that inhomogeneity occurs in the image density.

FIG. 21 shows a case where the image forming apparatus is a four-cycle color printer which forms a full color image by overlaying toners of four colors of yellow (Y), cyan (C), magenta (M), and black (K). Also in this case, a rotation signal for an image carrier turns ON at time "to". At the same time, a charging signal turns ON. Then, at time "ta", exposure operation begins. At time "tr", development operation begins. At time "ts", transfer operation begins. In such a four-cycle color printer, these exposure operation, development operation, and transfer operation are repeated on the same image carrier four times.

Also in this example, the development operation is initiated or terminated during the exposure operation at time "tr" and "tu", respectively. Accordingly, vibrations in the apparatus and a fluctuation in the circumferential speed of the image carrier occur at these timings. Further, since the transfer signal turns ON and OFF respectively at time "ts" and "tv" during the exposure operation, vibrations occur in the apparatus also at these timings. This causes color shift (misalignment) in the color image formation, and hence degrades the quality.

FIG. 22 shows a case where the image forming apparatus is a tandem type color printer in which image carriers of black (K), cyan (C), magenta (M), and yellow (Y) are arranged so as to form an image by overlaying these colors successively. At time "th" exposure operation is initiated. At time "ti" development operation is initiated. At time "tj", primary transfer operation turns ON (c). In such a tandem type color printer, these kinds of operations are performed in parallel for the four colors.

At time "tk", secondary transfer operation is initiated, while at time "tm", the primary transfer operation is terminated. Further, at time "tn", the secondary transfer operation is terminated. Also in the secondary transfer operation, vibrations or the like occur owing to driving operation for the transfer roller and paper feed operation. Thus, similarly to the cases of the development operation and the primary transfer operation, in a case where an ON or OFF signal for the secondary transfer is generated during the exposure operation, color shift occurs and degrades the printing quality.

The above-mentioned vibrations in the apparatus and the fluctuation in the circumferential speed of the image carrier occurring in synchronization with various steps in the sequence of the operation of the image forming apparatus have degraded the precision in the exposure position and hence have caused the problem of density inhomogeneity (banding phenomenon). Further, in the color printers in which a plurality of colors are overlaid, color shift or the like has been caused by the vibrations and the fluctuation described above. In short, the prior art has the problem that the vibrations in the apparatus and the fluctuation in the circumferential speed of the image carrier occurring in synchronization with various steps in the sequence of the operation of the image forming apparatus degrade the printing quality.

In such an image forming apparatus, when the image carrier is driven by a drive motor, the circumferential speed fluctuation is caused by the gear tooth pitch of a gear wheel linked with the image carrier.

FIG. 23 shows the characteristics of the circumferential speed fluctuation in the image carrier and the size of the image generated by exposure. The horizontal axis indicates time T, while the vertical axis indicates the circumferential speed V of the image carrier. Va indicates a normal value for the circumferential speed. The circumferential speed varies in the form of a sine wave having a period of t1 owing to the rotation error caused by the gear tooth pitch of the gear wheel linked with the image carrier.

As time advances, the circumferential speed increases starting at the normal value Va. The circumferential speed reaches the maximum Vb at time "ta1". After that, the circumferential speed decreases as time advances. The circumferential speed returns to the normal value Va at time "tb1". Then, as time advances, the circumferential speed further decreases from the normal value Va. The circumferential speed reaches the minimum Vc at time "tc1". After that, the circumferential speed returns to the normal value Va at time "td1". A half of the cycle of the circumferential speed fluctuation is designated as t2.

When the circumferential speed is at the normal value Va, an image Gx is formed in a normal circular shape. When the circumferential speed is at the maximum Vb, an image Ga is formed in an elliptical shape having the major axis in the secondary scanning direction, and has a larger exposure area than the normal case. When the circumferential speed is at the minimum Vc, an image Gb is formed in an elliptical shape having the major axis in the primary scanning direction, and has a smaller exposure area than the normal case.

As such, the inhomogeneity in the circumferential speed of the image carrier caused by the gear tooth pitch results in density inhomogeneity. This is because: (1) the inhomogeneity in the circumferential speed of the image carrier causes a difference between the spot shapes at an exposure position having a higher circumferential speed and at an exposure position having a lower circumferential speed; and (2) these spots have a difference in the exposure energy per unit area. These two reasons (1) and (2) cause the density inhomogeneity. Further, in the case of a color printer for overlaying a plurality of colors, color shift is caused.

FIG. 24A shows an example of image formation in a case where a fluctuation occurs in the circumferential speed of the image carrier as described with reference to FIG. 23. Symbol X denotes the paper feeding direction (secondary scanning direction).

A normal image Gx is formed in the pixel line Sa at a certain time. After the image carrier travels in the direction indicated by X, the next pixel line Sb reaches the exposure position. At that time, the circumferential speed has increased from Va to Vb. Thus, an image Ga is formed in an elliptical shape having the major axis in the secondary scanning direction. After the image carrier further travels in the direction X, the next pixel line Sc reaches the exposure position. At that time, the circumferential speed has decreased from the Vb to the normal value Va. Thus, a normal image Gx is formed in the pixel line Sc.

After the image carrier further travels in the direction X, the next pixel line Sd reaches the exposure position. At that time, the circumferential speed has decreased from Va to Vc. Thus, an image Gb is formed in an elliptical shape having the major axis in the primary scanning direction. In subsequent processes, a series of images Gx-Ga-Gx-Gb-Gx is periodically repeated. This indicates the occurrence of density inhomogeneity. FIG. 24B shows an example where a normal image Gx is formed in each of pixel lines Sa-Si for the comparison purpose.

In view of the above, Japanese Patent Publication No. 2000-98802A discloses that a flywheel is provided coaxially to a rotary shaft of an image carrier, and that the flywheel is arranged so as to rotate in association with the rotation of the image carrier. By virtue of this, the inertial moment generated by the rotating flywheel suppresses the velocity fluctuation, so that the density inhomogeneity is reduced.

Japanese Patent Publication No. 2000-112196A teaches that a viscous-fluid damper is provided in a rotary shaft so as to avoid the influence of the vibrations of the apparatus.

Japanese Patent Publication No. 2000-89640A teaches that the rotation of the image carrier is monitored by an encoder, and that the monitored value is compared with a reference value, so that the light emission timing is controlled.

The configuration disclosed in Japanese Patent Publication No. 2000-98802A causes an increase in the number of components. Further, the flywheel having significant size and weight causes an increase in the size and the weight of the apparatus. Similarly, the configuration disclosed in Japanese Patent Publication No. 2000-112196A causes an increase in the number of components, and hence unavoidably results in a cost increase. In both of these documents, a countermeasure is provided in the image carrier. Although the vibrations of the apparatus transmit through also to an image writing head, no proposal has so far been made where a countermeasure against the vibrations is provided in the image writing head. This has avoided a satisfactory solution to the problem of printing quality degradation.

The configuration disclosed in Japanese Patent Publication No. 2000-89640A causes unavoidably an increase in the number of components. Further, precise attachment of the encoder is difficult, and that complicated control is necessary in the timing control.

SUMMARY OF THE INVENTION

It is therefore an object of the invention to provide an image forming apparatus and an image forming method capable of suppressing a quality degradation of an obtained image caused by vibration generated in the apparatus or the circumferential speed fluctuation of a rotating image carrier in the apparatus.

In order to achieve the above object, according to the invention, there is provided an image forming apparatus, comprising:

an image carrier, configured to rotate in a first direction;

an image writer, adapted to irradiate the image carrier to form an electrostatic latent image thereon;

a storage, which stores information regarding a factor disturbing the formation of the latent image in advance; and a controller, which controls the irradiation of the image writer so as to eliminate the disturbing factor, based on the information stored in the storage.

According to the optical control, the factor for disturbing the latent image formation, that is, the quality degrading factor of the image formation can be suppressed without increasing the number of mechanical parts. Therefore, it is possible to avoid the size increase and the weight increase of the apparatus.

Specifically, the disturbing factor is generated synchronously with an operation sequence of the image formation apparatus.

More specifically, the disturbing factor is generated in accordance with vibrations in the apparatus.

Here, it is preferable that the controller controls a timing at which the formation of the latent image is performed, when the vibrations are generated.

It is further preferable that the controller does not perform the formation of the latent image for a first part of the image carrier corresponding to a first timing when the vibrations are generated, and performs a subsequent formation of the latent image for both of the first part of the image carrier and a second part of the image carrier subsequent to the first part.

In other words, since the latent image formation is not performed during the generation of the disturbing factor, the obtained image quality can be secured. Further, even if such a temporal omission of the latent image formation is executed, the image carrier can be uniformly irradiated by the subsequent irradiation.

Alternatively, the disturbing factor is generated in accordance with fluctuations of a circumferential speed of the rotation of the image carrier.

Here, it is preferable that the controller controls an exposure amount for a part where the latent image is formed at a timing when the circumferential speed fluctuates.

It is further preferable that the controller increases the exposure amount when the circumferential speed increases, and decreases the exposure amount when the circumferential speed decreases.

In other words, the image carrier is uniformly irradiated even when the circumferential speed of the rotation thereof fluctuates, the obtained image quality can be secured.

Preferably, a developer develops the latent image as a visible toner image; and a density sensor detects a density change in the toner image. The disturbing information is obtained from the density change.

Preferably, the image writer is a line head in which a plurality of light emitter arrays are arranged in the first direction; and each of the light emitter arrays includes a plurality of light emitters arrayed in a second direction perpendicular to the first direction.

Here it is preferable that each of the light emitters is an organic electro luminescence type element. Since the electro luminescence type element is operated by a static control, the configuration of the controller can be simplified.

Preferably, the image writer includes an optics for scanning a light beam.

Preferably, the image writer simultaneously performs the formation of the latent image for a plurality of linear regions arrayed in the first direction; and each of the linear regions extends in a second direction perpendicular to the first direction.

Preferably, a plurality of image formation units are arranged in a direction that a recording medium is transported; and each of the image formation units comprises the image carrier and the image writer.

Alternatively, each of a plurality of developers is subsequently opposed to the image carrier to supply one color of toner onto the image carrier to make the latent image as a visible toner image.

Here, it is preferable that a transferer transfers the toner image from the image carrier to a transferring member.

According to the invention, there is also provided an image forming method, comprising steps of:

providing an image carrier configured to rotate in a first direction;

providing an image writer, adapted to irradiate the image carrier to form an electrostatic latent image thereon;

storing information regarding a factor disturbing the formation of the latent image in a storage in advance; and controlling the irradiation of the image writer so as to eliminate the disturbing factor, based on the information stored in the storage.

According to the invention, there is provided an image forming apparatus, comprising:

an image carrier, configured to rotate in a first direction;

an image writer, adapted to irradiate the image carrier to form an electrostatic latent image thereon, the image writer comprises a plurality of light emitter arrays arranged in the first direction, each of the light emitter arrays including a plurality of light emitters arrayed in a second direction perpendicular to the first direction; and a plurality of gear wheels connecting the image carrier and a drive source for driving the image carrier, wherein the following relationship is established $$L1 > \frac{kn \cdot mn \cdot Ln}{2}$$

where: L1 denotes a length of the light emitter arrays in the first direction; Ln denotes a gear tooth pitch of n-th one of the gear wheels other than one gear wheel linked directly with the image carrier; mn denotes a reduction ratio of the image carrier to the n-th gear wheel; and kn denotes a constant determined from an outer diameter of the image carrier and a diameter of a pitch circle of the n-th gear wheel.

With this configuration, the affection of the circumferential speed fluctuation of the rotation of the image carrier due to the error in the tooth pitch of the gear wheels can be eliminated, thereby suppressing the quality degrading factor for the image formation.

Preferably, each of the light emitters is an organic electro luminescence type element.

Preferably, a plurality of image formation units are arranged in a direction that a recording medium is transported; and each of the image formation units comprises the image carrier and the image writer.

Alternatively, each of a plurality of developers is subsequently opposed to the image carrier to supply one color of toner onto the image carrier to make the latent image as a visible toner image.

For both cases, it is preferable that a transferer transfers the toner image from the image carrier to a transferring member adapted to temporarily hold the toner image thereon before the toner image is plenarily transferred onto a recording medium.

According to the invention, there is also provided an image forming apparatus, comprising:

an image carrier, configured to rotate in a first direction;

an image writer, adapted to irradiate the image carrier to form an electrostatic latent image thereon, the image writer comprises a plurality of light emitter arrays arranged in the first direction, each of the light emitter arrays including a plurality of light emitters arrayed in a second direction perpendicular to the first direction; and a plurality of gear wheels connecting the image carrier and a drive source for driving the image carrier, wherein the following relationship is established $$L1 > \frac{kLx}{2}$$

where: L1 denotes a length of the light emitter arrays in the first direction; Ln denotes a gear tooth pitch of one of the gear wheels linked directly with the image carrier; and k denotes a constant determined from an outer diameter of the image carrier and a diameter of a pitch circle of the one of the gear wheels.

With this configuration, the affection of the circumferential speed fluctuation of the rotation of the image carrier due to the error in the tooth pitch of the gear wheels can be eliminated, thereby suppressing the quality degrading factor for the image formation. Especially, since the countermeasure is established with respect to the gear wheel which is most affective to the image carrier, the above effect can be attained effectively.

Preferably, each of the light emitters is an organic electro luminescence type element.

Preferably, a plurality of image formation units are arranged in a direction that a recording medium is transported; and each of the image formation units comprises the image carrier and the image writer.

Alternatively, each of a plurality of developers is subsequently opposed to the image carrier to supply one color of toner onto the image carrier to make the latent image as a visible toner image.

For both cases, it is preferable that a transferer transfers the toner image from the image carrier to a transferring member adapted to temporarily hold the toner image thereon before the toner image is plenarily transferred onto a recording medium.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
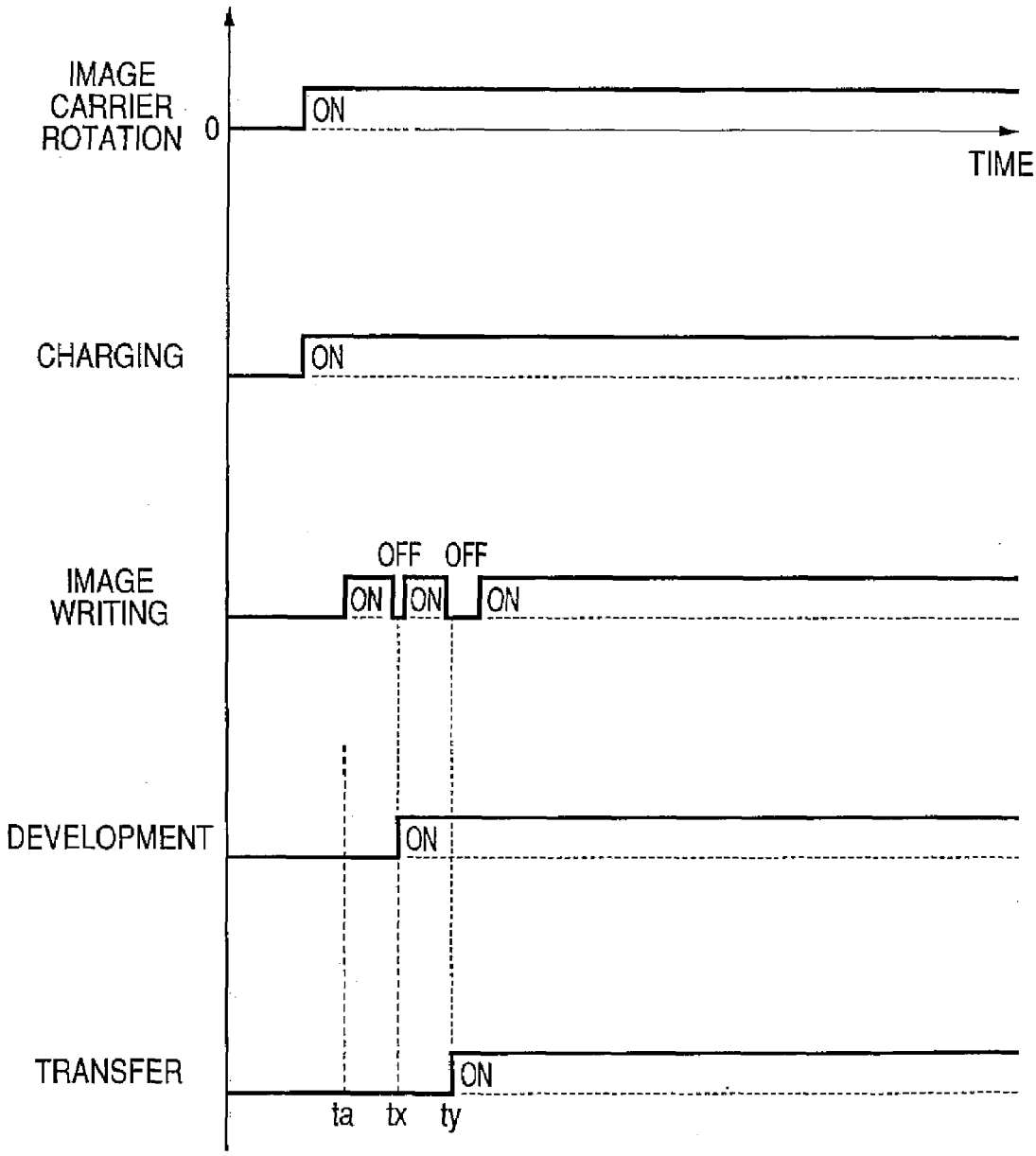
FIG. 1 is a time chart for explaining a sequence performed in an image forming apparatus according to a first embodiment of the invention.

FIG. 1 shows a timing chart of a sequence performed in a monochromatic printer which is an image forming apparatus according to a first embodiment of the invention.

In this embodiment, at time "ta", exposure (image writing) operation begins. However, at the timing that an activation signal for the developer turns ON at time "tx", and at the timing that a transfer activation signal turns ON at time "ty", the exposure operation is deactivated temporarily.

FIGS. 2A through 2D specifically show the above operation. In these figures, each blank circle indicates a light emitter out of light emission, while each hatched circle indicates a light emitter in light emission. The image carrier travels in the direction indicated by an arrow X (secondary scanning direction). Time advances in the order from FIGS. 2A to 2D.

During the rotation of the image carrier, vibrations occur at the timings of ON and OFF of the activation signals for a developer and a transferer as described the above. In this embodiment, the exposure operation is stopped at these timings of the occurrence of vibrations in the apparatus. Then, after the image carrier travels in the secondary scanning direction, the scanning lines lacking the exposure are scanned and undergo exposure at the same timing as the normal exposure.

Figures 2A, 2B, 2C, 2D:
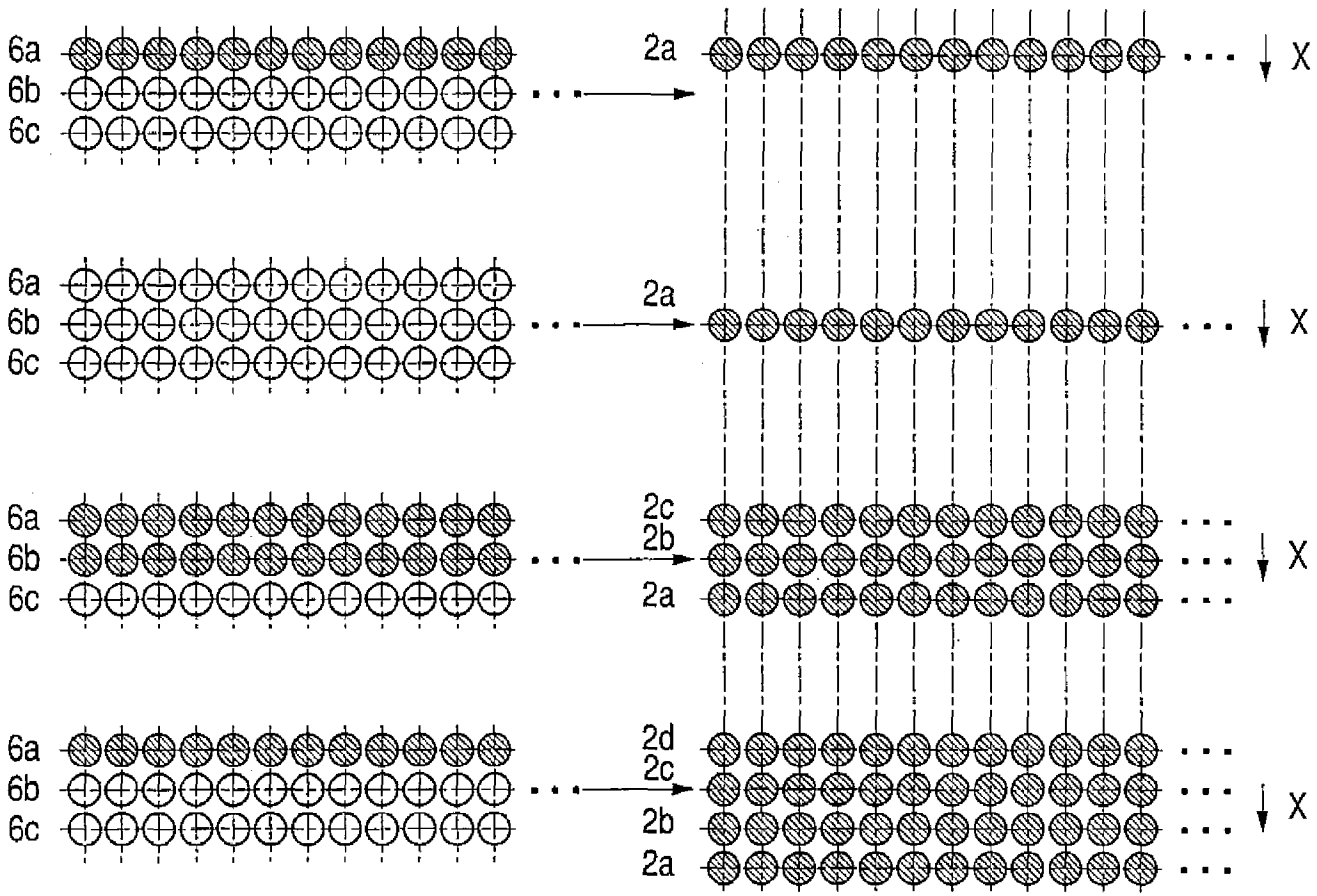
FIGS. 2A to 2D are diagrams for explaining the operations of light emitters in the image forming apparatus of FIG. 1.

This process is described below in detail. In the normal exposure as shown in FIG. 2A, all the light emitters in the light emitter array 6*a* arranged in an image writing head is operated to perform exposure (image writing) onto a pixel line 2*a*. At the timing when vibrations occur in the apparatus, all the light emitter arrays 6*a*-6*c* stop the exposure operation as shown in FIG. 2B. Thus, even after the image carrier travels in the secondary scanning direction, the image carrier is in a state where the pixel line 2*a* solely has undergone exposure. Then, as shown in FIG. 2C, a plurality of the light emitter arrays 6*a* and 6*b* are operated to perform the exposure operation, so that pixel lines 2*b* and 2*c* on the image carrier undergo exposure from the light emitter arrays 6*a* and 6*b*. As a result, the image carrier is in a state where the three pixel lines have undergone exposure, including the pixel line 2*a* having previously undergone exposure. Subsequently, as shown in FIG. 2D, the light emitter array 6*a* is solely operated to perform the normal exposure onto a pixel line 2*d*.

As such, according to the present embodiment of the invention, exposure operation is stopped at the timing of vibrations of the apparatus occurring in synchronization with the sequence. This suppresses printing quality degradation such as density inhomogeneity and color shift (misalignment).

Incidentally, since the time points when the vibrations of the apparatus in synchronization with the sequence occur can be specified in advance, a storage stores in advance such timings. Then, a controller reads from the storage the timing information, and thereby controls and causes all the light emitter arrays to stop the exposure operation at these timings.

Figure 3:
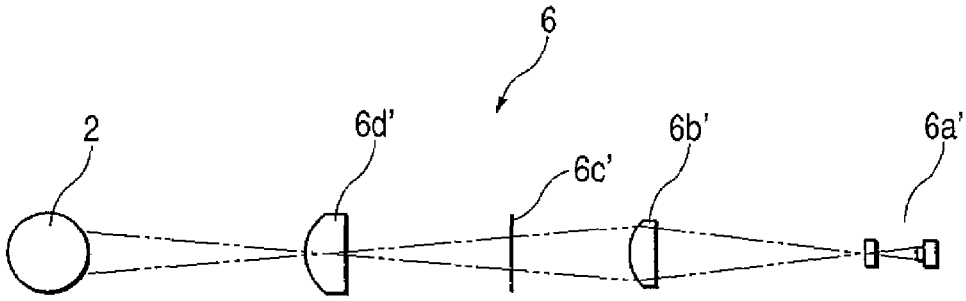
FIG. 3 is a schematic view showing a multi-beam scanning type optical system including the light emitters.
Figure 4:
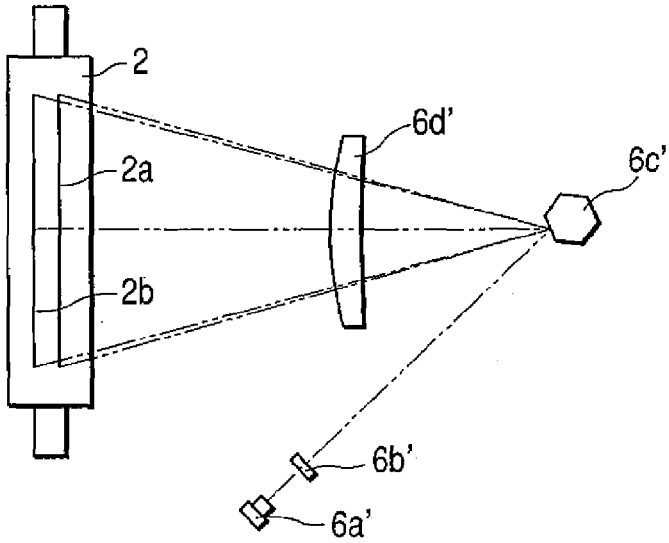
FIG. 4 is a plan view of the optical system of FIG. 3.

FIGS. 3 and 4 show a case where the image writer used is a scanning optical system of a multi-beam scanning type. In FIG. 3, an exposure unit 6 comprises a light emitter 6*a*', a collimator lens 6*b*', a deflector 6*c*', and an imaging lens 6*d*'. This scanning optical system forms an exposure plane on an image carrier 2. In the light emitter 6*a*', light emitters are arranged, for example, in the form of a two-dimensional semiconductor laser array.

As shown in FIG. 4, the deflector 6*c*' is composed of a rotary polygonal mirror. In this case, emitted light from the two-dimensionally arranged light emitters write a plurality of scanning lines such as 2*a* and 2*b* simultaneously on the image carrier. When this configuration, each one of light beams on the image carrier 2 can be independently modulated.

This permits the stop of exposure operation, that is, the stop of writing of scanning lines on the image carrier, at the time points of the occurrence of vibrations in the apparatus. Thus, the printing quality degradation such as density inhomogeneity and color shift caused by the vibrations can be accurately suppressed with a simple control. Also in this case, a storage stores in advance the information of the timings of the vibrations of the apparatus occurring in synchronization with the sequence.

Since the image writer is configured to be able to perform the image writing with respect to a plurality of scanning lines simultaneously, pixel-line based control of the exposure value for the image carrier, and hence simplifies the configuration of the controller.

Figure 21:
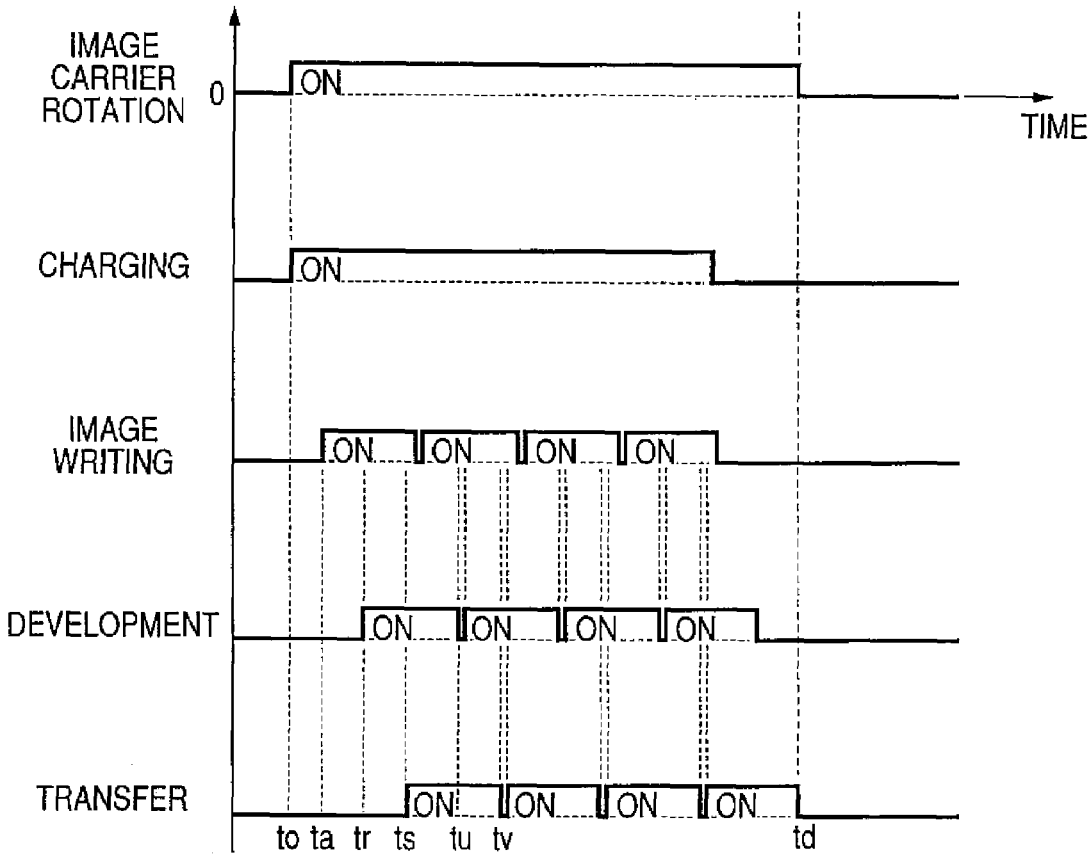
FIG. 21 is a time chart for explaining generation of image quality degradation in a four-cycle type color printer.
Figure 22:
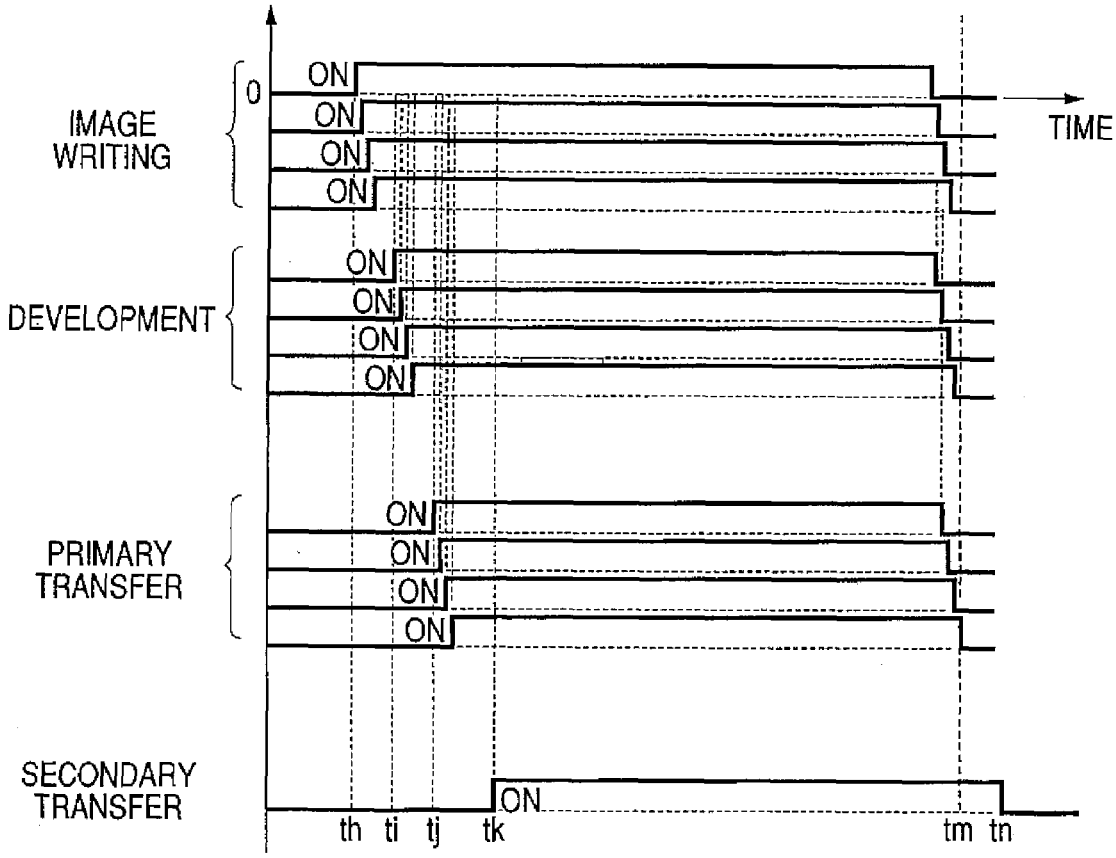
FIG. 22 is a time chart for explaining generation of image quality degradation in a tandem type color printer.

The above described control operations can be applied to the four-cycle type color printer as described with reference to FIG. 21 and the tandem-type color printer as described with reference to FIG. 22. In these cases, the invention has the effect of suppressing the occurrence of color shift (misalignment).

Next, a second embodiment of the invention will be described with reference to FIGS. 5A and 5B.

Figure 5A:
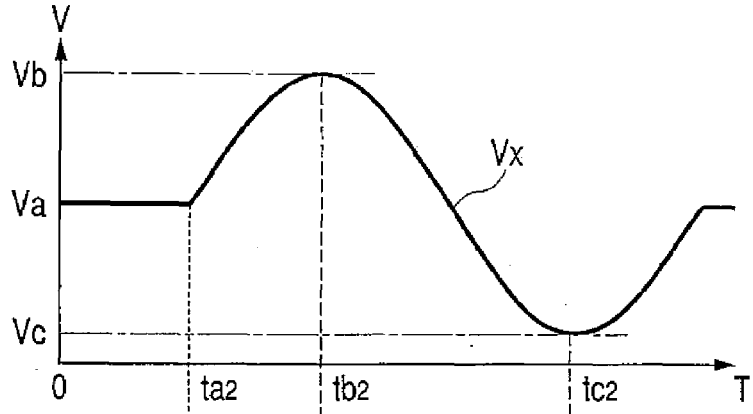
FIGS. 5A and 5B are diagrams for explaining operation performed in an image forming apparatus according to a second embodiment of the invention.

As shown in FIG. 5A, during the rotation of the image carrier at a circumferential speed of Va, the circumferential speed varies at the above-mentioned timings of ON and OFF of the activation signals for the developer and the transferer.

More specifically, at time "ta2", the circumferential speed begins to increase, and reaches a peak value Vb at time "tb2". After that, the circumferential speed begins to decrease, and reaches a minimum value Vc at time "tc2". Then, the circumferential speed begins to increase again. In a case where the circumferential speed of the image carrier varies as described here, the image density suffers a fluctuation as long as the light emission value is constant. That is, the image density decreases at higher circumferential speed values, and increases at lower circumferential speed values. This causes density inhomogeneity.

Figure 5B:
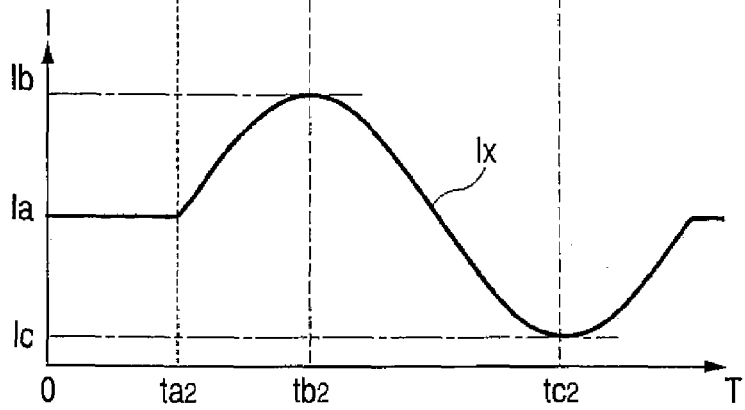

In this embodiment, as shown in FIG. 5B, the light emission value of the exposure unit is maintained at "Ia" in an early stage. However, when the circumferential speed of the image carrier begins to increase at time "ta2", the light intensity of a light emitter is set to increase so as to increase the light emission value. At time "tb2", the light emission value reaches a peak value "Ib". After that, the light emission value begins to decrease, and reaches a minimum value "Ic" at time "tc2". Then, the light emission value begins to increase again.

As such, in this embodiment, when the circumferential speed of the image carrier varies as shown in FIG. 2A, the light emission value is varied at the same rate as the fluctuation in the circumferential speed. That is, the light intensity of the light emitter is controlled such that the waveform "Ix" of the relation between the time and the light emission value in the exposure unit has similarity to the waveform Vx of the relation between the time and the circumferential speed in the image carrier. Also in this embodiment, the fluctuation characteristics of the circumferential speed shown in FIG. 5A is stored in a storage in advance. Then, a controller controls the light intensity of the light emitter arranged in a line head, such that the characteristics of the exposure value of the exposure unit follows the waveform of FIG. 5B.

Figure 6:
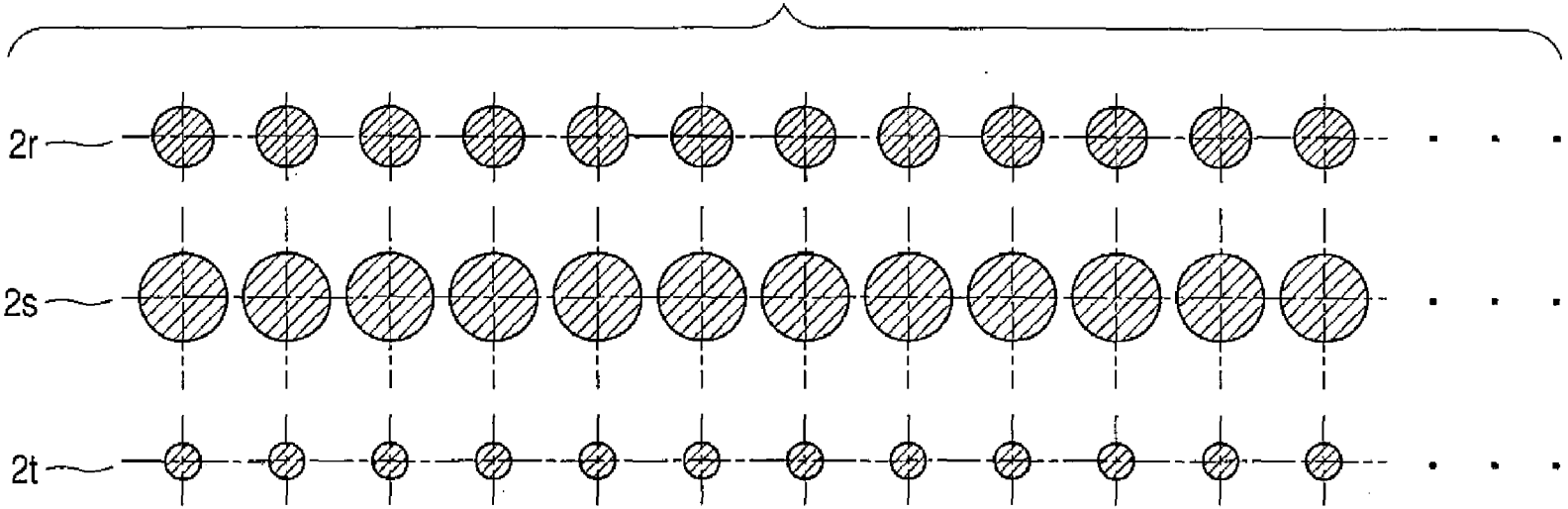
FIG. 6 is a diagram showing images obtained by the operation performed in the image forming apparatus of the second embodiment.

In FIG. 6, part 2*r* shows a pixel line subjected to exposure at a normal light emission rate. Part 2*s* shows a case where the light emission rate is increased, that is, the light intensity of the light emitters is increased in the time interval ta2 to tb2 shown in FIG. 5B. Part 2*t* shows a case where the light emission rate is reduced, that is, the light intensity of the light emitters is reduced in the time interval tb2 to tc2 shown in FIG. 5B.

In this embodiment, the exposure unit is composed of image writer such as an organic EL device in which the light emission rate is controllable, and controls the light emission rate at the timing of a change in the circumferential speed occurring in synchronization with the operation sequence of the image forming units. In this control, the light emission rate is increased when the circumferential speed of the image carrier increases, while the light emission rate is reduced when the circumferential speed of the image carrier decreases.

As shown in FIGS. 5A and 5B, the time points when the speed fluctuation in synchronization with the operation sequence of the image forming units occur can be specified in advance. Thus, the exposure value is controlled at these timings, so that the exposure value is adjusted such as to suppress density inhomogeneity. Further, in the case of a color printer, the occurrence of color shift is suppressed.

Figures 7A, 7B, 7C:
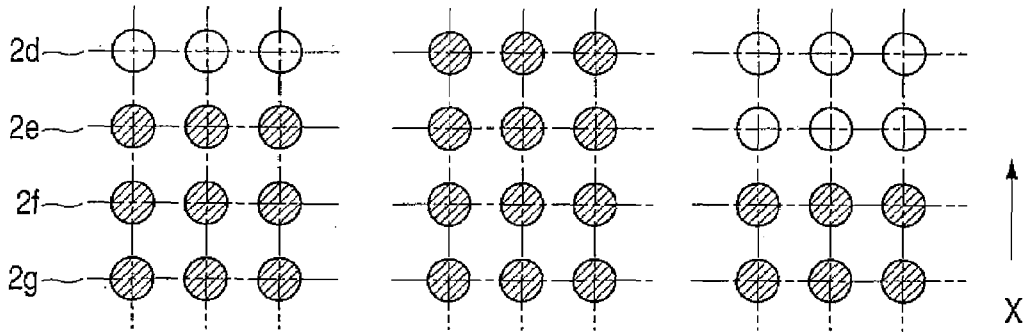
FIGS. 7A to 7C are diagrams for explaining operation performed in an image forming apparatus according to a first modified example of the second embodiment.

FIGS. 7A through 7C show a first modified example of the second embodiment. In these figures, each blank circle indicates a light emitter out of light emission, while each hatched circle indicates a light emitter in light emission. The image carrier travels in the direction indicated by an arrow X (secondary scanning direction). In normal exposure, an light emitter array 2*d* is out of light emission as shown in FIG. 7A. When the light emission rate is to be increased, that is, in the time interval ta2 to tb2 shown in FIG. 5B, all the light emitter arrays 2*d* to 2*g* are in light emission as shown in FIG. 7B.

When the light emission rate is to be decreased, that is, in the time interval tb2 to tc2 shown in FIG. 5B, the light emitter arrays 2*d* and 2*e* are out of light emission as shown in FIG. 7C. As such, the image writer implemented as a line head is such that a plurality of light emitter arrays are arranged in the secondary scanning direction so as to perform multiple exposure. In the multiple exposure, exposure value control is performed by changing the number of operated light emitter arrays. This simplifies the exposure value control.

Figure 8A:
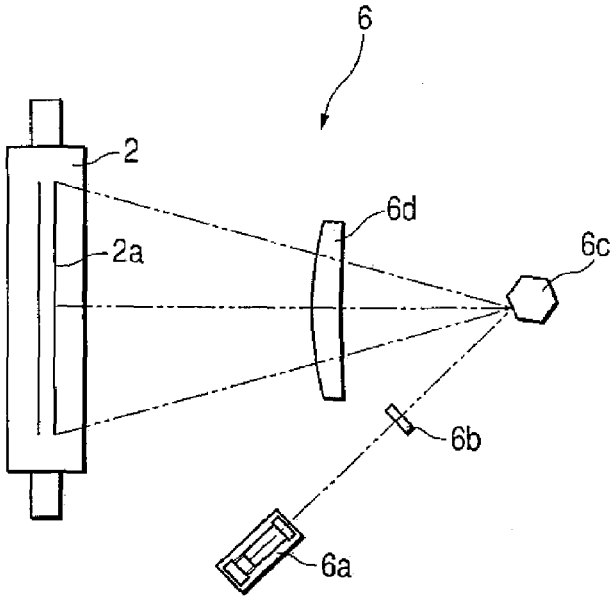
FIGS. 8A and 8B are diagrams for explaining operation performed in an image forming apparatus according to a second modified example of the second embodiment.
Figure 8B:
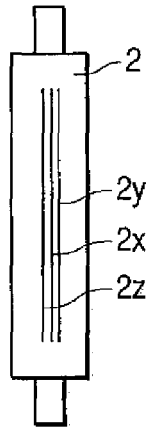

FIG. 8A shows a case where a scanning optical system is used as the image writer, as a second modified example of the second embodiment. In this case, an exposure unit 6 comprises a light emitter 6*a*, a collimator lens 6*b*, a rotary polygonal mirror 6*c*, and an imaging lens 6*d*. This scanning optical system forms an exposure plane 2*a* on an image carrier 2. In response to the change in the circumferential speed of the image carrier, the light emitter 6*a* is controlled so as to expose a portion 2×having a normal exposure value, a portion 2*y* having a low exposure value, and a portion 2*z* having a high exposure value. As such, exposure control is achieved only by the control of the light emitter 6*a* (light source). This simplifies the configuration.

Figure 9:
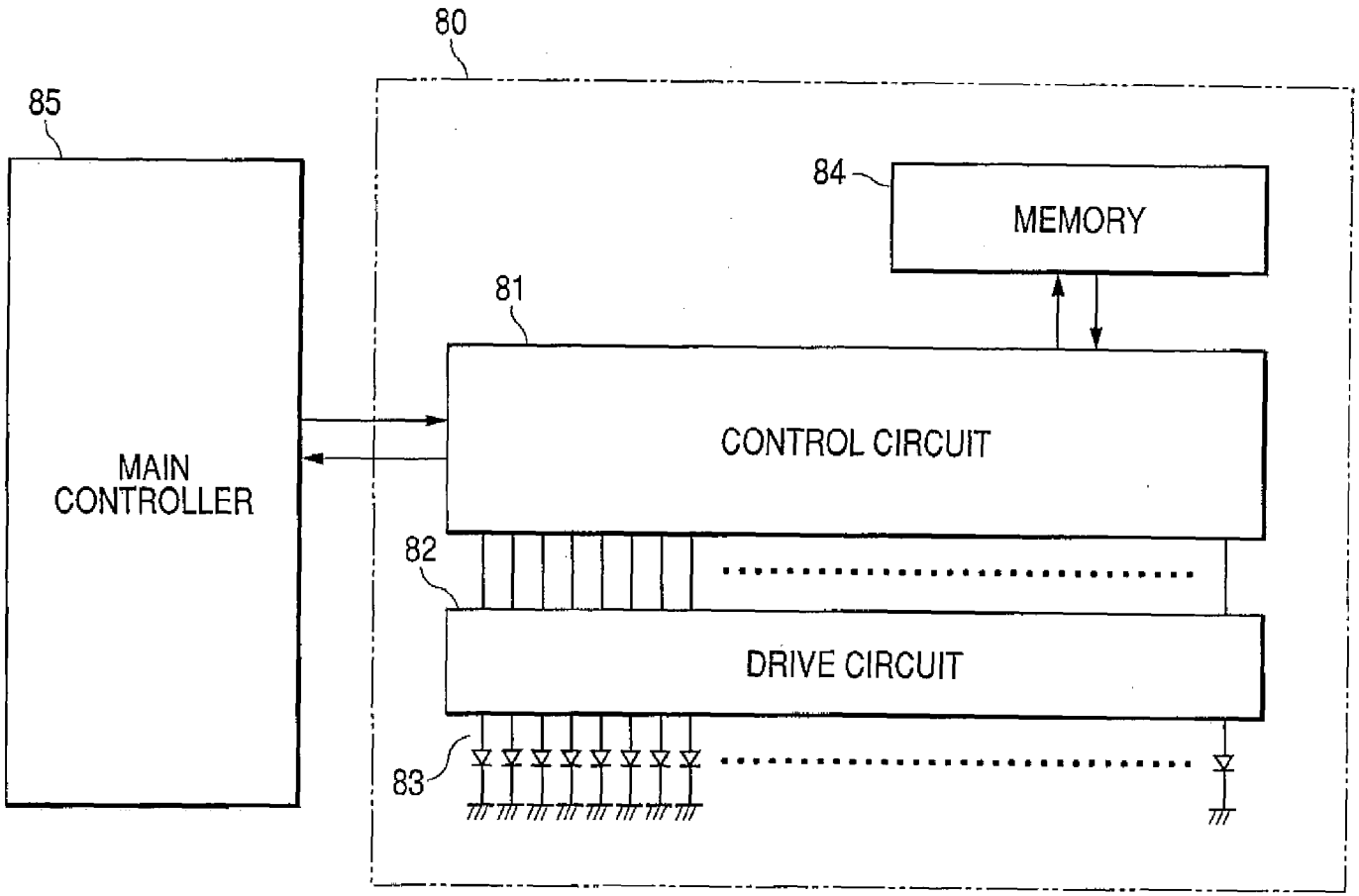
FIG. 9 is a block diagram showing one example of a circuit configuration of a head controller incorporated in the image forming apparatus of the above embodiments.

FIG. 9 shows one example of a circuit configuration applicable to the above embodiments. A controller 80 of a line head (image writer) comprises: a control circuit 81; a drive circuit 82; light emitters 83 each composed of an organic EL device or the like; and a memory (storage) 84. The organic EL device can be controlled statically, and hence advantageously simplifies the control system.

A main controller 85 generates image data, and then transmits the image data to the control circuit 81. The control circuit 81 generates a control signal corresponding to the light emission rate of each light emitter 83, so as to control the drive circuit 82 composed of TFTs (thin film transistors) or the like.

The memory 84 stores the timings of ON and OFF of activation signals for the developer and the transferee. That is, the memory 84 stores information (printing quality degrading factors) concerning the vibrations occurring in synchronization with the operation sequence of a plurality of the image forming units constituting the image forming apparatus.

The memory 84 also stores information concerning the fluctuation in the circumferential speed of an image carrier as described in FIG. 5A. As such, the memory 84 serves as storage for storing in advance the information concerning the printing quality degrading factors in the image formation. On the basis of the printing quality degrading factors in the image formation stored in the memory 84, the drive circuit 82 outputs a signal for stopping the exposure operation to each organic EL device, during the occurrence of vibrations in synchronization with the sequence. Further, the drive circuit 82 controls the light emission value (light intensity) of each light emitter, such that the exposure value follows the characteristics of the circumferential speed fluctuation as described in FIG. 5B.

In this example, the memory 84 is provided on the image writing head together with the light emitters 83. This reduces the amount of data to be transmitted from the image forming apparatus to the image writing head, and hence reduces the necessary number of wirings between the apparatus main body and the image writing head. Further, the memory 84 is formed on the same substrate as the light emitters 83. This permits integrated fabrication of the light emitters 83 and the memory 84. Further, this avoids the necessity of fabricating the light emitters 83 and the memory 84 on separate chips from each other, and hence reduces the fabrication cost.

Moreover, since the light emitters 83 and the drive circuit 82 are formed on the same substrate, the length of the signal lines connecting them can be reduced.

Figure 10:
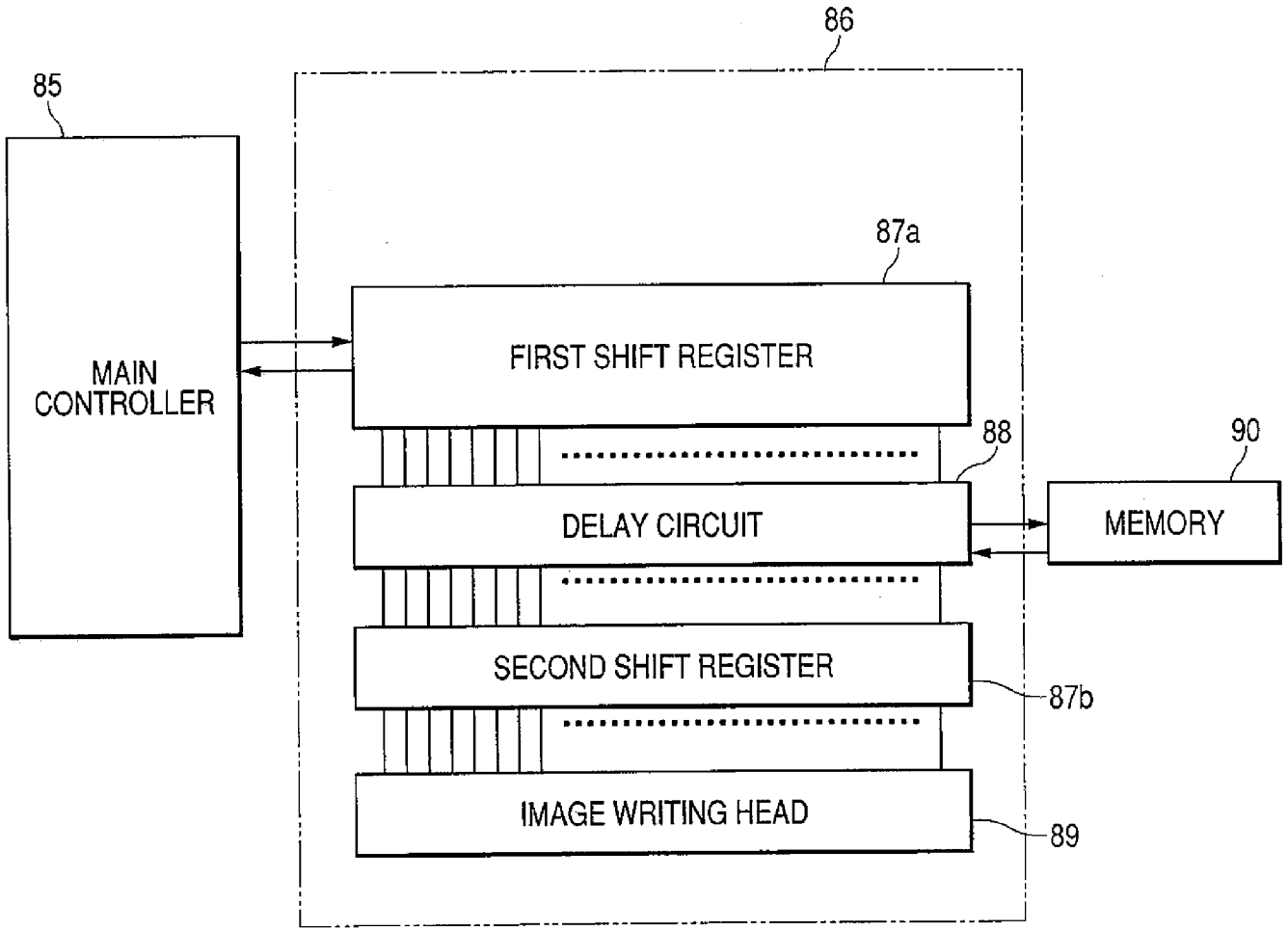
FIG. 10 is a block diagram showing another example of a circuit configuration of the head controller.

FIG. 10 shows another example of a circuit configuration applicable to the above embodiments. In this example, a memory 90 is provided outside an image writing head 89, and stores the timings of ON and OFF of activation signals for the developer and the transferer. The memory 90 also stores information concerning the fluctuation in the circumferential speed of an image carrier as described in FIG. 5A. Thus, the memory 90 serves as storage for storing in advance the information concerning the printing quality degrading factors in the image formation.

A main controller 85 inputs image data to a first shift register 87*a* provided in a head controller 86. The first shift register 87*a* is used for outputting the image data to each light emitter array in the image writing head 89.

The output signal of the first shift register 87*a* is delayed by a predetermined time by a delay circuit 88. The length of the delay time for each light emitter array is set appropriately. The output signal from the delay circuit 88 is provided through a second shift register 87*b* to the image writing head 89. The second shift register 87*b* outputs a signal through each signal line, so as to drive sequentially each light emitter of the image writing head 89.

Also in this example, the head controller 86 outputs a signal for stopping the exposure operation to each light emitter such as an organic EL device, during the occurrence of the vibrations in synchronization with the sequence. Further, the head controller 86 controls the light emission rate of each light emitter, such that the exposure value follows the characteristics of the circumferential speed fluctuation in the image carrier as described in FIG. 5B. Such a control can be implemented by a CPU (not shown) provided in the delay circuit 88.

Since the memory 90 is provided in an engine controller separately from the image writing head 89, even when a failure occurs in the image writing head 89 owing to any reason, the information is maintained securely. Alternatively, the memory 90 may be provided in a cartridge containing the exposure unit. The first and second shift registers 87*a* and 87*b* are formed on the same substrate as the light emitters. This permits integrated fabrication of the light emitters and the shift registers. Further, this avoids the necessity of fabricating the light emitters and the shift registers on separate chips from each other, and hence reduces the fabrication cost.

The main controller 85 generates image data for a first one of the light emitter arrays. Then, the image data is retained in the shift register, and transferred inside the shift register, so that the operation of all the light emitter arrays in the image writing head 89 can be controlled. Thus, the main controller 85 does not need to generate data for all the light emitter arrays, and hence the circuit configuration is simplified. Further, data processing is performed at a high speed. This circuit configuration is applied, for example, to an image writing head performing multiple exposure.

As described above, the occurrence of printing quality degrading factors such as density inhomogeneity and color shift associated with the gear tooth pitch is caused by the inhomogeneity in the circumferential speed of the image carrier. Such a problem associated with the gear tooth pitch occurs in every gear wheel in a gear train for driving the image carrier. Thus, in order to resolve the problem, a third embodiment of the invention adopts the following configuration for the multiple exposure.

Figure 11:
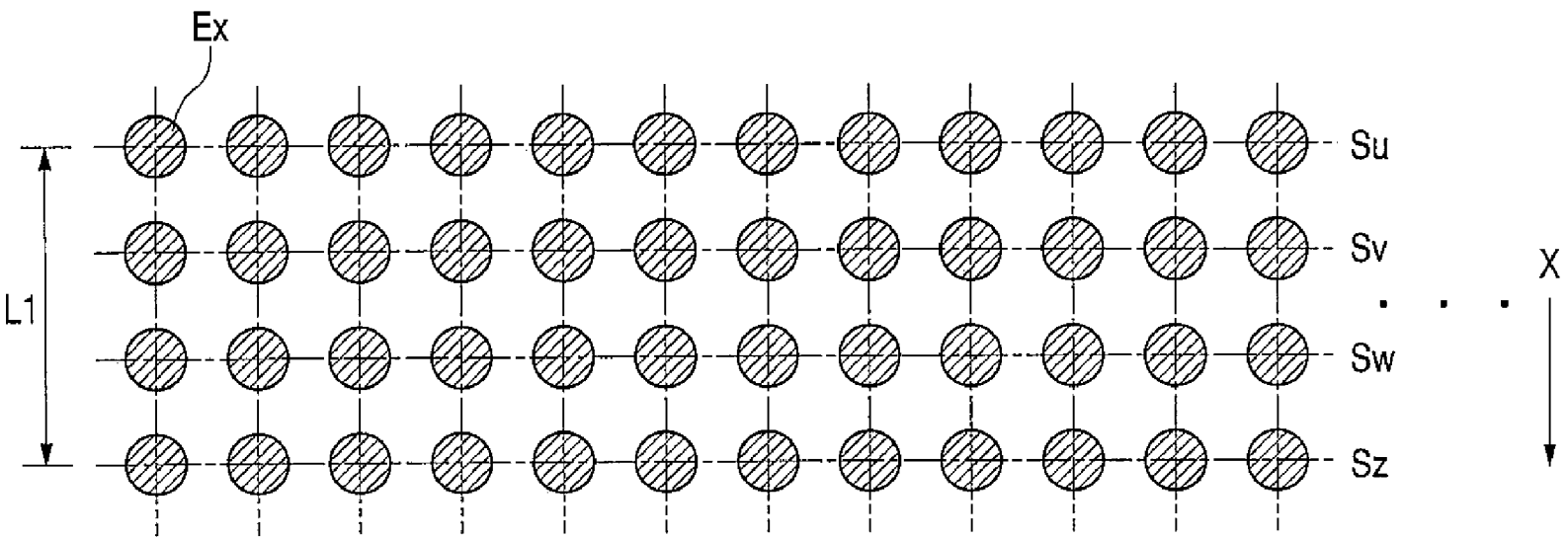
FIG. 11 is a diagram showing light emitter arrays in an image writing head incorporated in an image forming apparatus according to a third embodiment of the invention.

FIG. 11 is a diagram illustrating multiple exposure onto an image carrier. In this example, a plurality of light emitters Ex are arranged in each of light emitter arrays Su to Sz. The light emitter array Su corresponds to the first exposure point. The light emitter array Sz corresponds to the last exposure point. The distance L1 corresponds to the distance between the pixel line center of the first light emission point and the pixel line center of the last light emission point in multiple exposure. That is, L1 denotes the length in the secondary scanning direction of the light emitter arrays arranged in the image writing head. The direction indicated by an arrow X indicates the secondary scanning direction (paper feeding direction).

Figure 12:
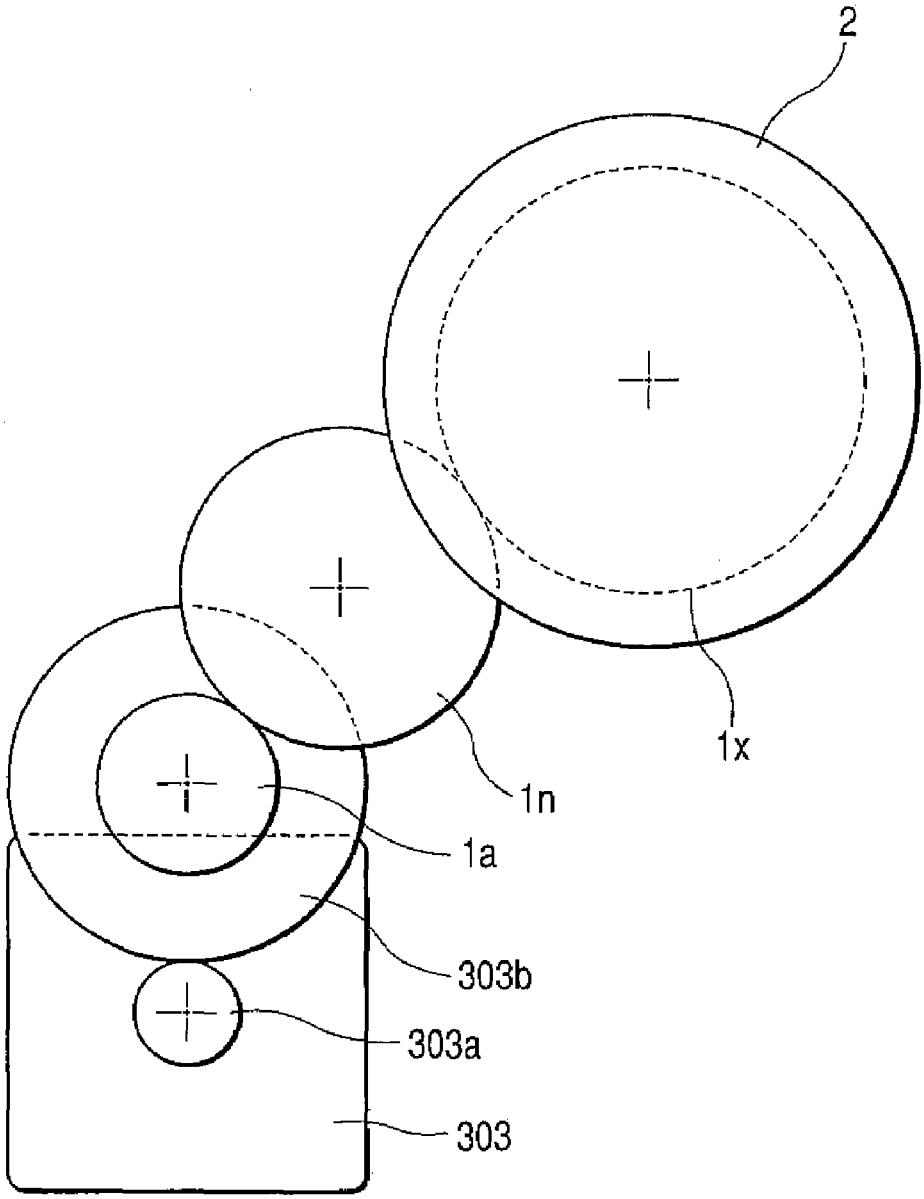
FIG. 12 is a diagram showing a gear train for driving an image carrier incorporated in the image forming apparatus of the third embodiment.

FIG. 12 shows the configuration of the gear train. An intermediate gear wheel 303*b* is engaged with a gear wheel 303*a* linked with an output shaft of a drive motor 303. A gear wheel 1*a* is provided coaxially to the gear wheel 303*b*, so that the output of the drive motor 303 is transmitted through an intermediate gear wheel 1*n* to a gear wheel 1*x* linked directly with an image carrier 2. Here, the intermediate gear wheel 1*n* indicates any one of the gear wheels ranging from the gear wheel (n=1) engaged with the output shaft 303*a* of the drive motor 303 to the n-th gear wheel 1*n* immediately before the gear wheel 1*x* linked directly with the image carrier 2.

Figure 13:
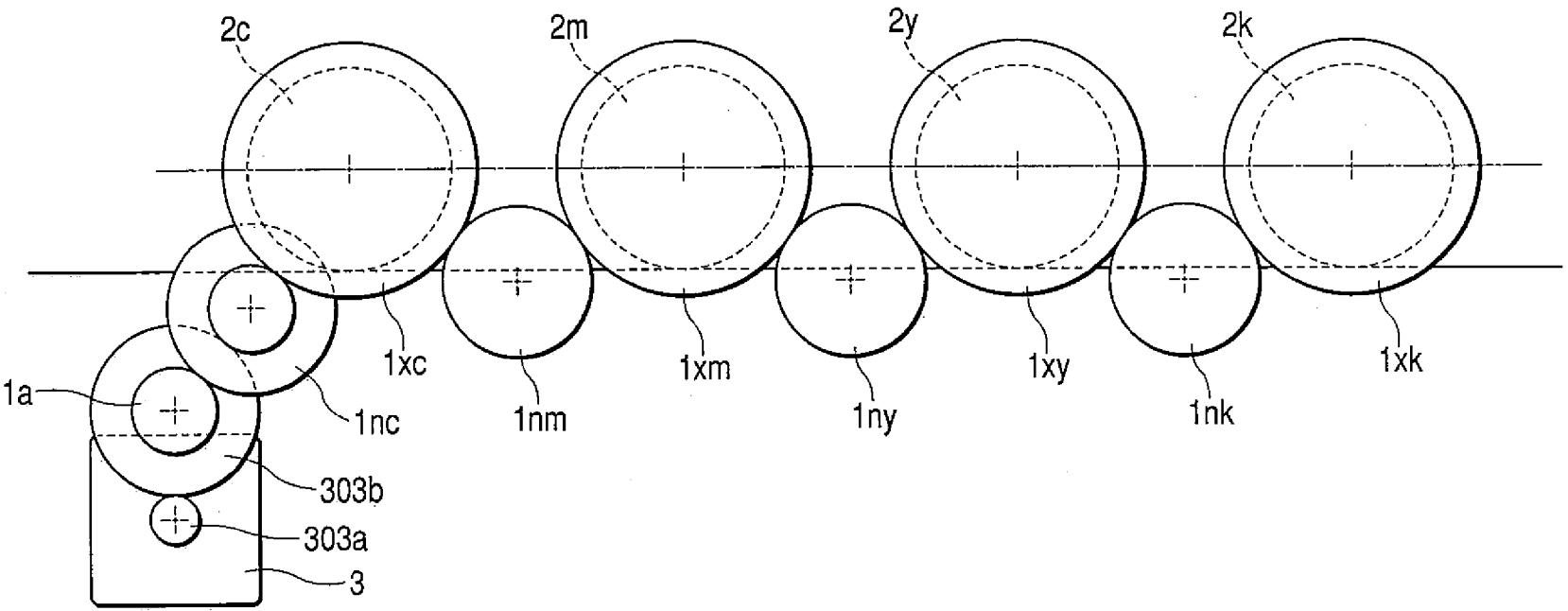
FIG. 13 is a diagram showing a case where the gear train of FIG. 12 is incorporated in a tandem-type color printer.

FIG. 13 shows a case where the above gear train is incorporated in a tandem-type color printer comprising four image carriers 2*c* (cyan), 2*m* (magenta), 2*y* (yellow), and 2*k* (black) having the same configuration, respectively.

Numerals 1*nc*, 1*nm*, 1*ny*, and 1*nk* indicate intermediate gear wheels each for transmitting the power of the drive motor to the image carrier for the corresponding color. Numerals 1*xc*, 1*xm*, 1*xy*, and 1*xk* indicate gear wheels each linked directly with the image carrier for the corresponding color. Each of the intermediate gear wheels indicates any one of gear wheels ranging from the gear wheel (n=1) engaged with the output shaft of the drive motor 303 to the n-th gear wheel 1*n* immediately before the gear wheel linked directly with the image carrier 2.

In this embodiment, the gear train is so configured as to establish the following relationship (1).

$$L1 > \frac{kn \cdot mn \cdot Ln}{2} \tag{1}$$

where: L1 is as defined the above; Ln denotes a gear tooth pitch (cf., FIG. 14B) of any one of the (n) gear wheels 1*n* (other than the gear wheel 1*x* linked directly with the image carrier 2); mn denotes an angular velocity ratio (reduction ratio) of the image carrier 2 to the n-th gear wheel 1*n* in the gear train; and kn denotes a constant determined from the outer diameter of the image carrier 2 and the diameter of the pitch circle of the n-th gear wheel 1*n* in the gear train.

Described below is the reason why the relation between L1 and Ln is set as mentioned above. In multiple exposure, the traveling time of the image carrier necessary for one spot exposure is denoted by "To" (this corresponds to "t3" in FIG. 23). Half the period of the speed fluctuation in the n-th gear wheel 1*n* in the gear train linked for transmitting the power from the drive source to the image carrier 2 is denoted by "Tn" (this corresponds to "t2" in FIG. 23). Then, when the relation "To>Tn" is satisfied for all "n", density inhomogeneity and color shift caused by the speed fluctuation are reduced to a certain extent.

As described above, when the length in the secondary scanning direction of the light emitter arrays is denoted by L1, and when the circumferential speed of the image carrier is denoted by V1, the relation "to=L1/V1" is obtained. Further, when the circumferential speed of the n-th gear wheel 1*n* in the gear train is denoted by Vn, the following relationship (2) is obtained.

$$m = \frac{1}{2}\frac{Ln}{Vn} \tag{2}$$

Here, since "To>Tn", the relation "L1/V1>Ln/2" Vn holds. From the relationship (2), the following relationship (3) is obtained.

$$L1 > \frac{V1}{Vn}\frac{Ln}{2} \tag{3}$$

Rewriting this inequality with angular velocities, $$L1 > \frac{R0 \cdot \omega 0}{Rn \cdot \omega n}\frac{Ln}{2} \tag{4}$$

where: R0 denotes the outer diameter of the image carrier 2; Rn denotes the diameter of the pitch circle of the n-th gear wheel 1*n*; linked with the image carrier is denoted by Rn; ω0 denotes an angular velocity of the image carrier 2; and ωn denotes an angular velocity of the n-th gear wheel 1*n*. Then, using kn=R0/Rn and mn=ω0/ωn, the above relationship (1) is obtained.

When the relation "To>Tn" is satisfied for all "n", that is when the relationship (1) is satisfied for all the gear wheels (other than the gear wheel 1*x* linked directly with the image carrier 2) in the gear train for driving the image carrier 2, the exposure time necessary for one spot becomes half of or longer than the period of the occurrence of density inhomogeneity. This reduces to a certain extent the density inhomogeneity caused by the speed fluctuation. That is, one spot contains a region where the circumferential speed of the image carrier is higher than the normal value Va and a region where the circumferential speed is lower than the normal value Va. And hence, the influences of the circumferential speed fluctuations cancel each other out. Thus, the printing quality degrading factor is suppressed, and the image quality is improved.

Figure 15A:
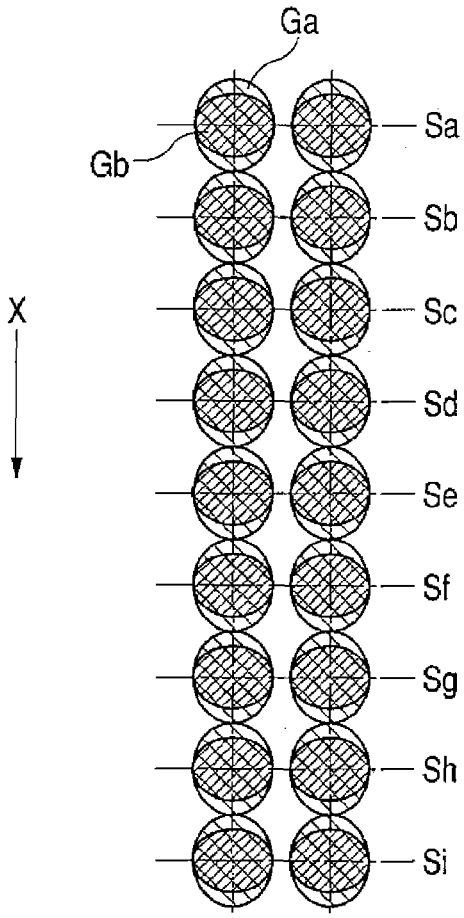
FIGS. 15A and 15B are diagrams for explaning an advantage obtained by the image formation apparatus of the third and fourth embodiments.
Figure 15B:
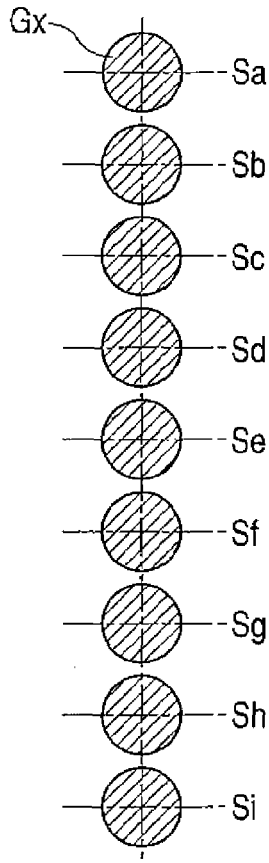

In this embodiment, as shown in FIG. 15A, an image Ga of elliptical shape having the major axis in the secondary scanning direction and an image Gb of elliptical shape having the major axis in the primary scanning direction are present in each of the pixel lines Sa to Si in a mixed manner. That is, the influence of fluctuations in the circumferential speed of the image carrier higher than the normal speed Va and the influence of fluctuations in the circumferential speed lower than the normal speed Va cancel each other out. Thus, in multiple exposure, in each of the pixel lines Sa to Si, image formation is performed with a shape and an exposure intensity similar to those of the normal image as in FIG. 15B which shows an example that a normal image Gx is formed on each of pixel lines Sa to Si.

Figure 23:
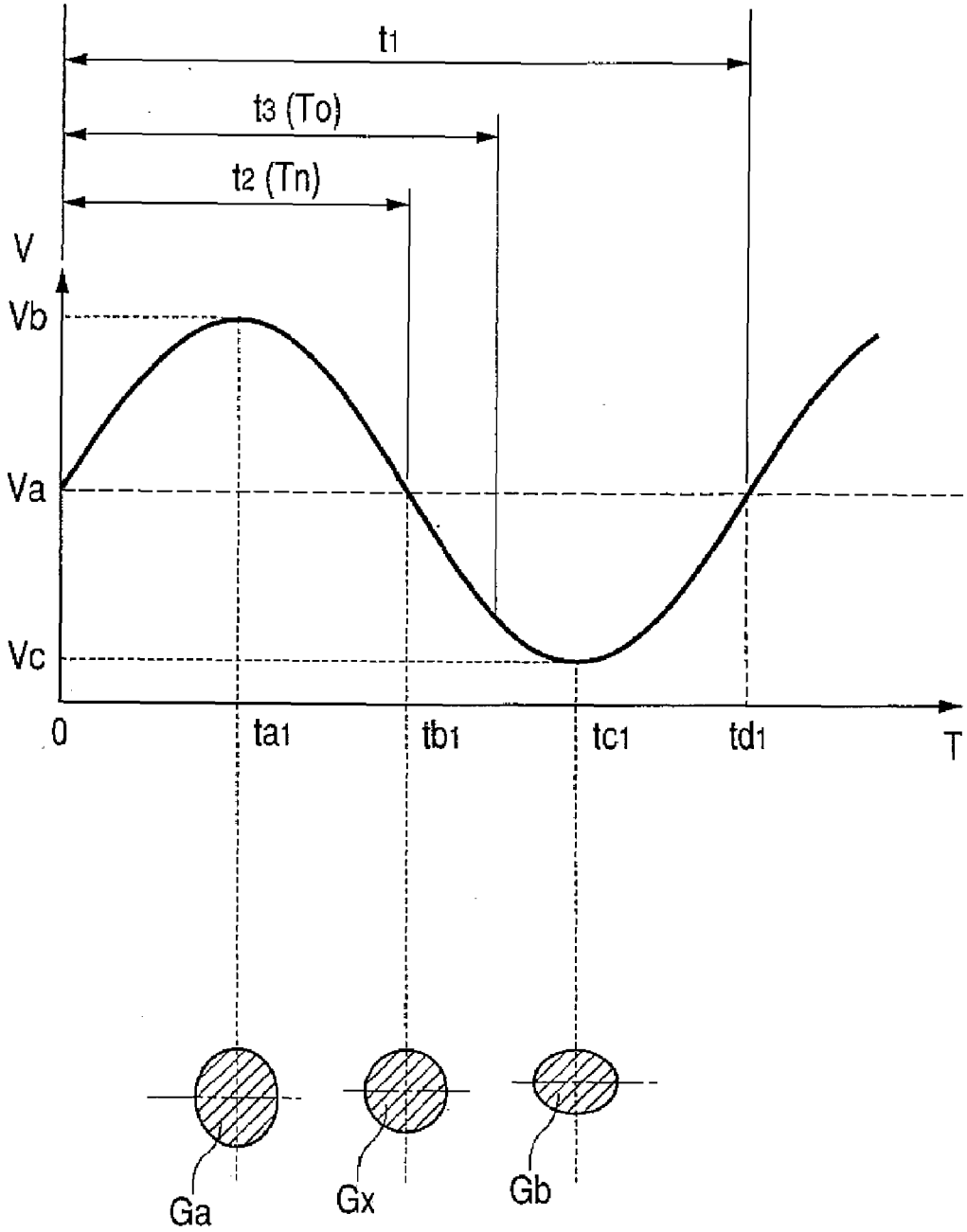
FIG. 23 is a diagram showing a relationship between circumferential speed fluctuation of an image carrier and a shape of an image formed on the image carrier.
Figure 24A:
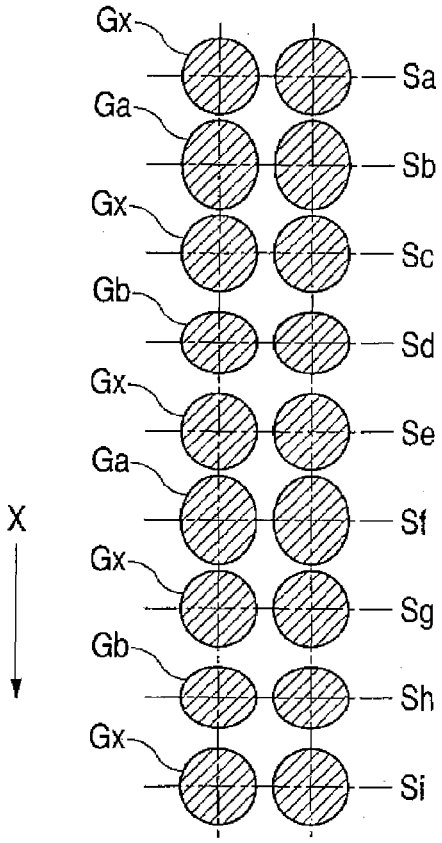
FIG. 24A is a diagram showing image shapes formed on successive pixel lines of the image carrier in a case where the circumferential speed fluctuation is occurred.
Figure 24B:
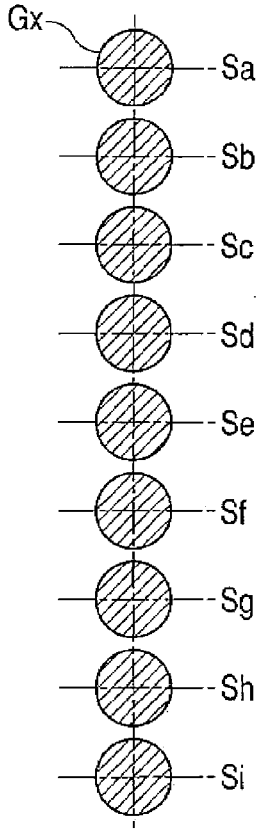
FIG. 24B is a diagram showing image shapes formed on successive pixel lines of the image carrier in a case where the circumferential speed fluctuation is not occurred.

Next, a fourth embodiment of the invention will be described. In order to attain the same advantage as the third embodiment, according to this embodiment, the relationship between the time intervals t2 and t3 shown in FIG. 23 is set as follows. Here, the time interval t2 indicates half the period (=t½) of the speed fluctuation in the gear wheel linked with an image carrier 2. The time interval t3 indicates the traveling time of the image carrier 2 necessary for one spot exposure. In this embodiment, the relationship between t2 and t3 is set so as to be t3>t2. As a result, the traveling time t3 of the image carrier 2 necessary for one spot exposure contains a region where the circumferential speed of the image carrier is higher than the normal value Va and a region where the circumferential speed is lower than the normal value Va. And hence, the influences of the circumferential speed changes cancel each other out.

Figure 14A:
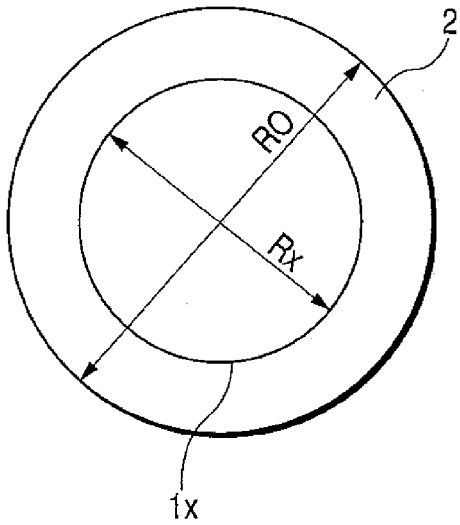
FIGS. 14A and 14B are diagrams showing a gear wheel directly linked with an image carrier which are incorporated in an image forming apparatus according to a fourth embodiment of the invention.
Figure 14B:
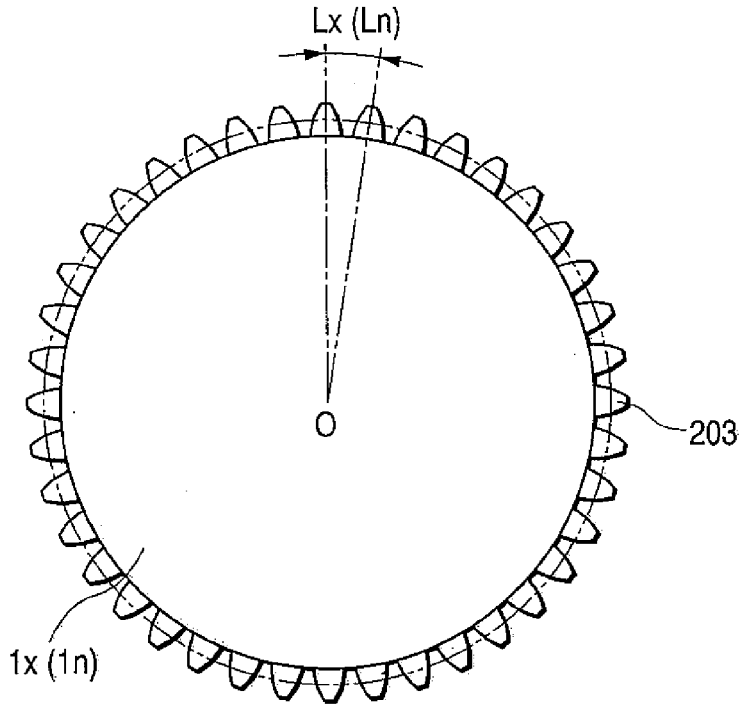

FIG. 14A shows a gear wheel 1*x* linked directly with the image carrier 2. The diameter of the image carrier 2 is denoted by R0. The diameter of the pitch circle of the directly linked gear wheel 1*x* is denoted by Rx. FIG. 14B is an enlarged view of the gear wheel 1*x*. Symbol O indicates the center of the gear wheel 1*x*. Numeral 203 indicates a tooth portion. Symbol Lx denotes one gear tooth pitch of the gear wheel 1*x*.

Here, the half period of the circumferential speed change in the gear wheel linked with the image carrier described in FIG. 6 is denoted by t2. The traveling time of the image carrier necessary for one spot exposure is denoted by t3. The circumferential speed of the gear wheel is denoted by V. The distance between the pixel line center of the first exposure point and the pixel line center of the last exposure point in multiple exposure, that is, the length of the light emitter array arranged in the secondary scanning direction in the line head, is denoted by L1. The length of one gear tooth pitch of the gear wheel is denoted by Lx. Then, the following relations hold between these parameters.

The relation between the time interval t3 and the length L1 (see FIG. 11) is t3=L1/kV. Here, k denotes a constant determined from the outer diameter of the image carrier 2 and the diameter of the pitch circle of the gear wheel 1*x* linked directly with the image carrier 2 (i.e., k=R0/Rx), and V denotes the circumferential speed of the gear wheel 1*x*. The relation between the time interval t2 and the length Lx is t2=Lx/2V. Since "t3>t2" is established as described above, the following relationship (5) is obtained.

$$L1 > \frac{kLx}{2} \tag{5}$$

In short, by satisfying the relationship (5), density inhomogeneity is suppressed in the image. Further, color shift is suppressed in color image formation as in the third embodiment explained with reference to FIGS. 15A and 15B. That is, these printing quality degradation factors are suppressed.

Figure 16:
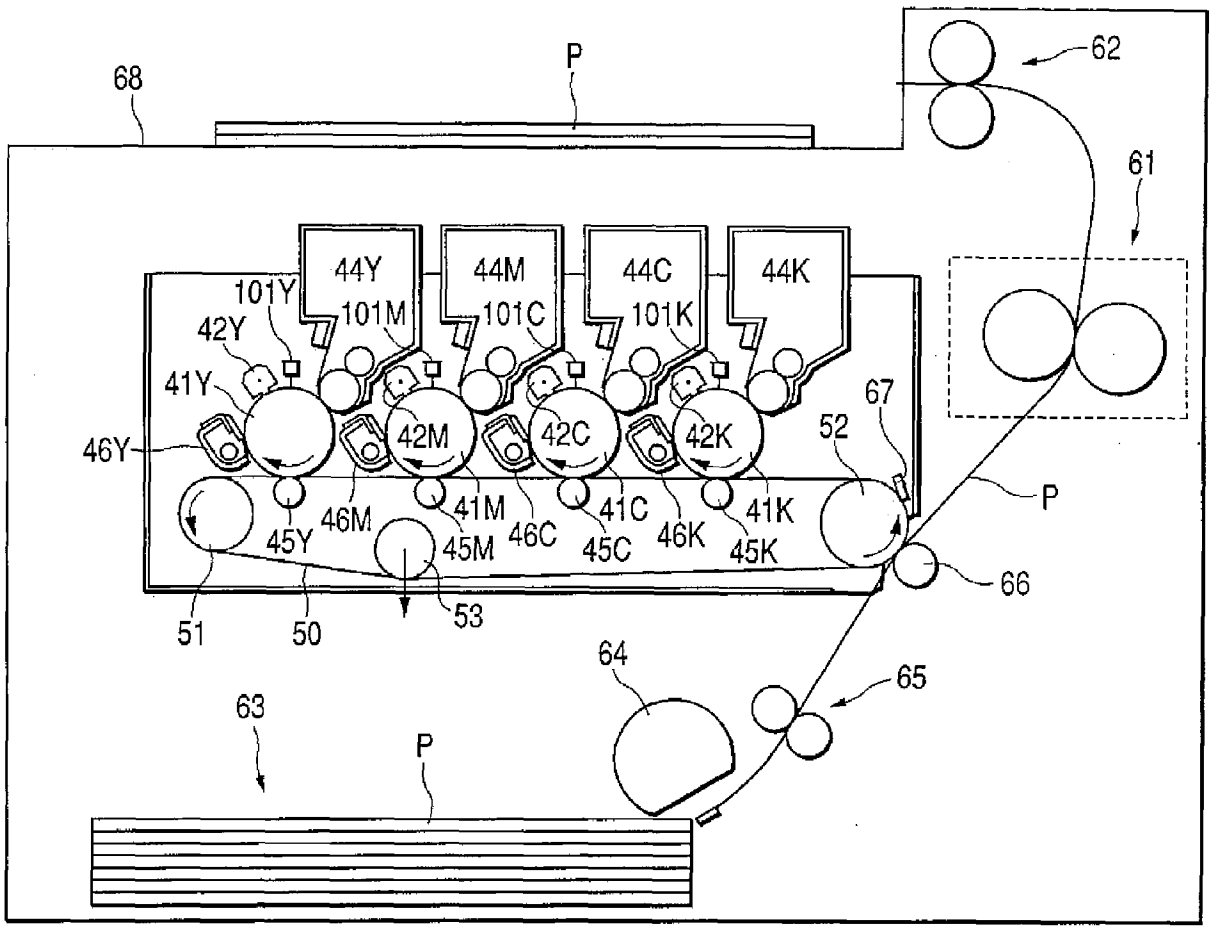
FIG. 16 is a schematic section view of a first example of an image forming apparatus of the above embodiments.

FIG. 16 shows a first example of an image forming apparatus incorporating the configuration of any one of the above embodiments. In this image forming apparatus, four image writing heads 101K, 101C, 101M, and 101Y having the same configuration are arranged respectively at the exposure positions for four corresponding image carriers 41K, 41C, 41M, and 41Y having the same configuration. This configuration is referred to as a tandem type image forming apparatus.

This image forming apparatus comprises: a driving roller 51; a follower roller 52; a tension roller 53; and an intermediate transfer belt 50 which is stretched with tension by the tension roller 53 and which is driven and circulated in the direction (counterclockwise) indicated by an arrow in FIG. 16. The four image carriers 41K, 41C, 41M, and 41Y each having a photosensitive layer on its outer periphery of a drum-shaped body are arranged at a predetermined interval relative to the intermediate transfer belt 50.

The characters K, C, M, and Y added to the reference numerals indicate black, cyan, magenta, and yellow, respectively. Thus, the four image carriers are those for black, cyan, magenta, and yellow. This is applied also to the other kinds of members. The image carriers 41K, 41C, 41M, and 41Y are driven and rotated in the direction (clockwise) indicated by an arrow in FIG. 16, in synchronization with the driving of the intermediate transfer belt 50.

Around each image carrier 41(K, C, M, or Y), arranged are: a corona charger 42(K, C, M, or Y) for charging uniformly the outer circumferential surface of the image carrier 41(K, C, M, or Y); and an image writing head (image writer) 101(K, C, M, or Y) provided with organic EL light emitters for scanning sequentially the outer circumferential surface charged uniformly by the charger 42(K, C, M, or Y), in synchronization with the rotation of the image carrier 41(K, C, M, or Y).

Further provided are: a developer 44(K, C, M, or Y) for imparting toner serving as a developer agent onto an electrostatic latent image formed by the image writing head 101(K, C, M, or Y) and thereby converting the image into a visible image (toner image); a primary transfer roller 45(K, C, M, or Y) for transferring sequentially the toner image developed by the developer 44(K, C, M, or Y) onto the intermediate transfer belt 50; and a cleaner 46(K, C, M, or Y) for removing toner remaining on the surface of the image carrier 41(K, C, M, or Y) after the transfer.

It should be noted that each image writing head 101 (K, C, M, or Y) is arranged such that the arrayed direction of the organic EL light emitters aligns with the generatrix of each image carrier 41(K, C, M, or Y). Further, the peak light emission energy wavelength of each image writing head 101(K, C, M, or Y) is set to agree approximately with the peak sensitivity wavelength of each image carrier 41(K, C, M, or Y).

In the developer 44(K, C, M, or Y), a non-magnetic single-component toner or the like is used as the developer agent. The single-component developer agent is transported to a development roller by a supply roller or the like. The film thickness of the developer agent adhered on the surface of the development roller is regulated by a control blade. Then, the development roller is contacted to or pressed against the image carrier 41(K, C, M, or Y), so as to cause the developer agent to be adhered thereto depending on the potential level on the image carrier 41(K, C, M, or Y), so that development into a toner image is performed.

The four toner images of black, cyan, magenta, and yellow generated by such four single-color toner image forming stations are primary-transferred sequentially onto the intermediate transfer belt 50 owing to a primary transfer bias applied on each primary transfer roller 45. A full-color toner image generated by overlaying these single-color toner images on the intermediate transfer belt 50 is secondary-transferred onto a recording medium P such as a paper sheet by a secondary transfer roller 66. The image is fixed on the recording medium P during the passage through a fixing roller pair 61. The recording medium P is then ejected through a paper ejection roller pair 62 into a paper ejection tray 68 provided on the top of the apparatus.

Numeral 63 indicates a paper feed cassette for retaining a stack of a large number of recording media P. Numeral 64 indicates a pick-up roller for feeding the recording medium P one by one from the paper feed cassette 63. Numeral 65 indicates a gate roller pair for defining the timing of feeding the recording medium P to a secondary transfer section of the secondary transfer roller 66. Numeral 67 indicates a cleaning blade for removing the toner remaining on the surface of the intermediate transfer belt 50 after the secondary transfer.

As such, this image forming apparatus uses organic EL light emitters as an image writing head. This permits size reduction of the apparatus in comparison with the use of a laser scanning optical system. The organic EL light emitters may be arranged so as to form a plurality of light emitter arrays arranged in the secondary scanning direction so as to perform multiple exposure.

Figure 17:
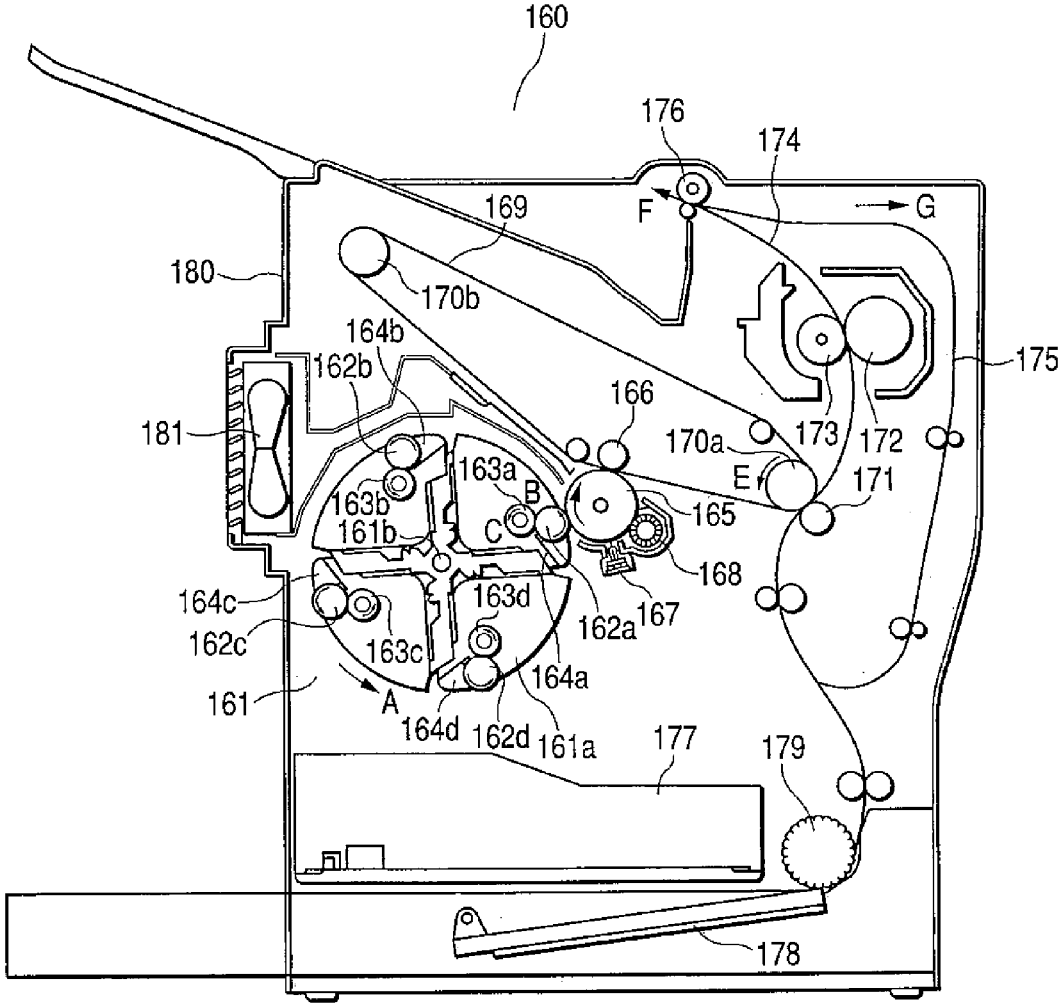
FIG. 17 is a schematic section view of a second example of an image forming apparatus of the above embodiments.

FIG. 17 shows a second example of an image forming apparatus incorporating the configuration of any one of the above embodiments. This image forming apparatus 160 comprises: a developer 161 arranged in rotary configuration; an image carrier 165; an image writing head (image writer) 167 having organic EL light emitter arrays for performing multiple exposure; an intermediate transfer belt 169; a paper transport passage 174; a heating roller 172 of a fuser; and a paper feeding tray 178.

In the developer 161, a development rotary 161*a* turns in the direction indicated by an arrow A around a shaft 161*b*. The inside of the development rotary 161*a* is separated into four sections each provided with one of the image forming units for four colors of yellow (Y), cyan (C), magenta (M), and black (K). Numerals 162*a* to 162*d* indicate development rollers each arranged in each of the image forming units for four colors and rotating in the direction indicated by an arrow B. Numerals 163*a* to 163*d* indicate toner supply rollers rotating in the direction indicated by an arrow C. Numerals 164*a* to 164*d* indicate control blades for regulating the toner thickness into a predetermined value.

Numeral 166 indicates a primary transfer member. Numeral 168 indicates a charger. The image carrier 165 is rotated in the direction indicated by an arrow D reverse to that of the development roller 162*a*, by a drive motor such as a stepping motor not shown.

The intermediate transfer belt 169 is stretched between a driving roller 170*a* and a follower roller 170*b*. The driving roller 170*a* is linked with a drive motor of the image carrier 165, so as to transmit the driving force to the intermediate transfer belt. When this drive motor operates, the driving roller 170*a* of the intermediate transfer belt 169 rotates in the direction indicated by an arrow E reverse to that of the image carrier 165.

The paper transport passage 174 comprises a plurality of transport rollers and a paper ejection roller pair 176, so as to transport a paper sheet. An image (toner image) of one side carried on the intermediate transfer belt 169 is transferred to one side of the paper sheet at the position of a secondary transfer roller 171. The secondary transfer roller 171 is set in contact or out of contact with the intermediate transfer belt 169 by a clutch mechanism. When the clutch is effected, the secondary transfer roller 171 is set in contact with the intermediate transfer belt 169, so that the image is transferred to the paper sheet.

The paper sheet carrying the image having been transferred as described above underturns a fusing process in the fuser comprising a heater H. The fuser comprises a heating roller 172 and a pressurizing roller 173. The paper sheet after the fixing process is drawn into the paper ejection roller pair 176, so as to travel in the direction indicated by an arrow F. In this state, when the paper ejection roller pair 176 turns reversely, the paper sheet travels reversely in the direction indicated by an arrow G through a paper transport passage 175 for double-side printing. Numeral 177 indicates an electric equipment box. Numeral 178 indicates a paper feeding tray for housing paper sheets. Numeral 179 indicates a pick-up roller provided at the exit of the paper feeding tray 178.

The drive motor used for driving the transport rollers in the paper transport passage is, for example, a low seed brushless motor. A stepping motor is used for the intermediate transfer belt 169 because of the necessity of color shift correction. These motors are controlled by signals provided from a controller not shown.

FIG. 17 shows a state that an electrostatic latent image of yellow (Y) is formed on the image carrier 165, and a high voltage is applied on the development roller 162*a*. As a result, an image of yellow is formed on the image carrier 165. When the backside image and the front side image of yellow are both transferred to the intermediate transfer belt 169, the development rotary 161*a* turns by 90 degrees in the direction indicated by the arrow A.

The intermediate transfer belt 169 circulates one turn, and returns to the position of the image carrier 165. Then, the two sides of images of cyan (C) are formed on the image carrier 165. These images are then overlaid on the images of yellow carried on the intermediate transfer belt 169. After that, similar processes are repeated. That is, the development rotary 161 turns by 90 degrees. And then, the intermediate transfer belt 169 turns one turn after the transfer of the images.

In order that all the images of four colors are transferred to the intermediate transfer belt 169, the intermediate transfer belt 169 needs to circulate four turns. After that, the turning position is controlled so that the images are transferred to a paper sheet at the position of the secondary transfer roller 171. A paper sheet fed from the paper feeding tray 178 is transported through the transport passage 174, and then one of the color images described above is transferred to one side of the paper sheet at the position of the secondary transfer roller 171. The paper sheet one side of which carries the transferred image is reversed by the paper ejection roller pair 176 as described above, and then waits in the transport passage. After that, at an appropriate timing, the paper sheet is transported to the position of the secondary transfer roller 171, so that the other color image is transferred to the other side. A housing 180 is provided with an exhaust fan 181.

Figure 18:
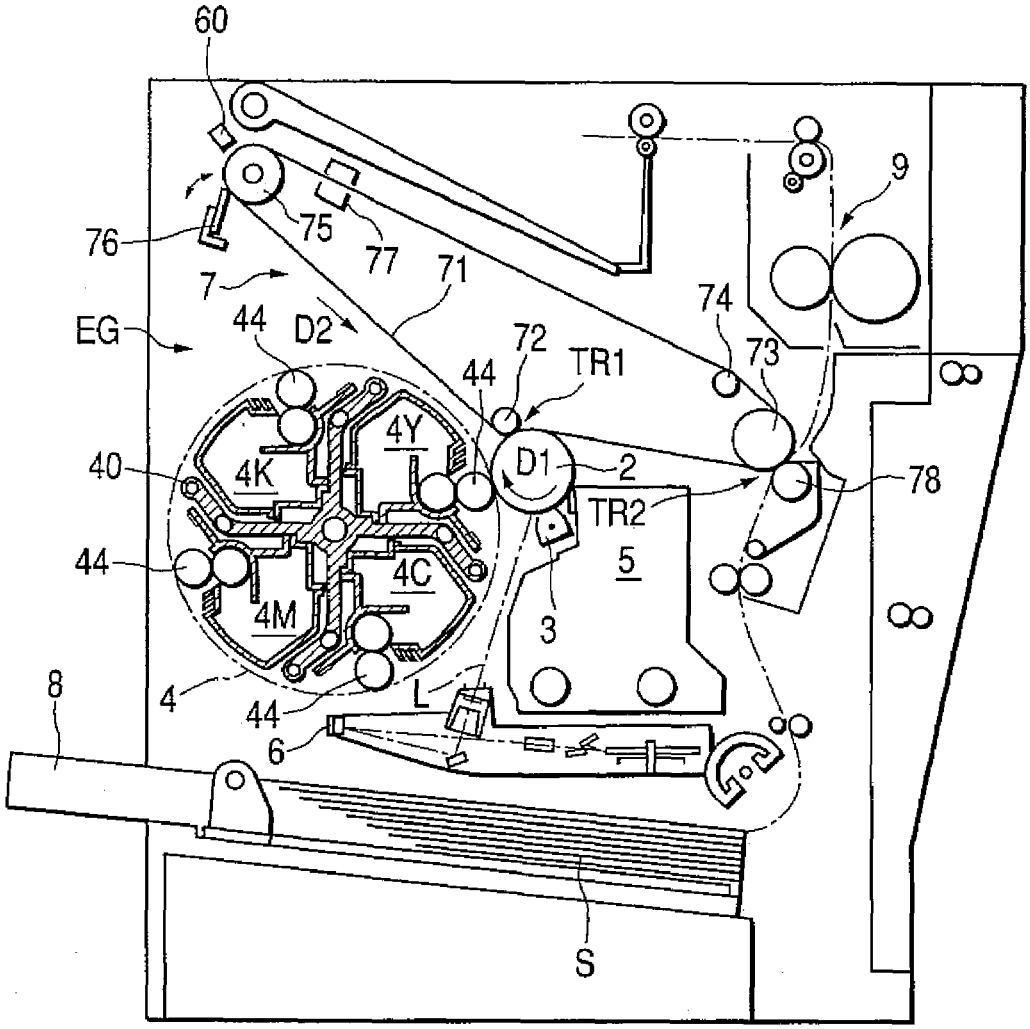
FIG. 18 is a schematic section view of a third example of an image forming apparatus of the above embodiments.
Figure 19:
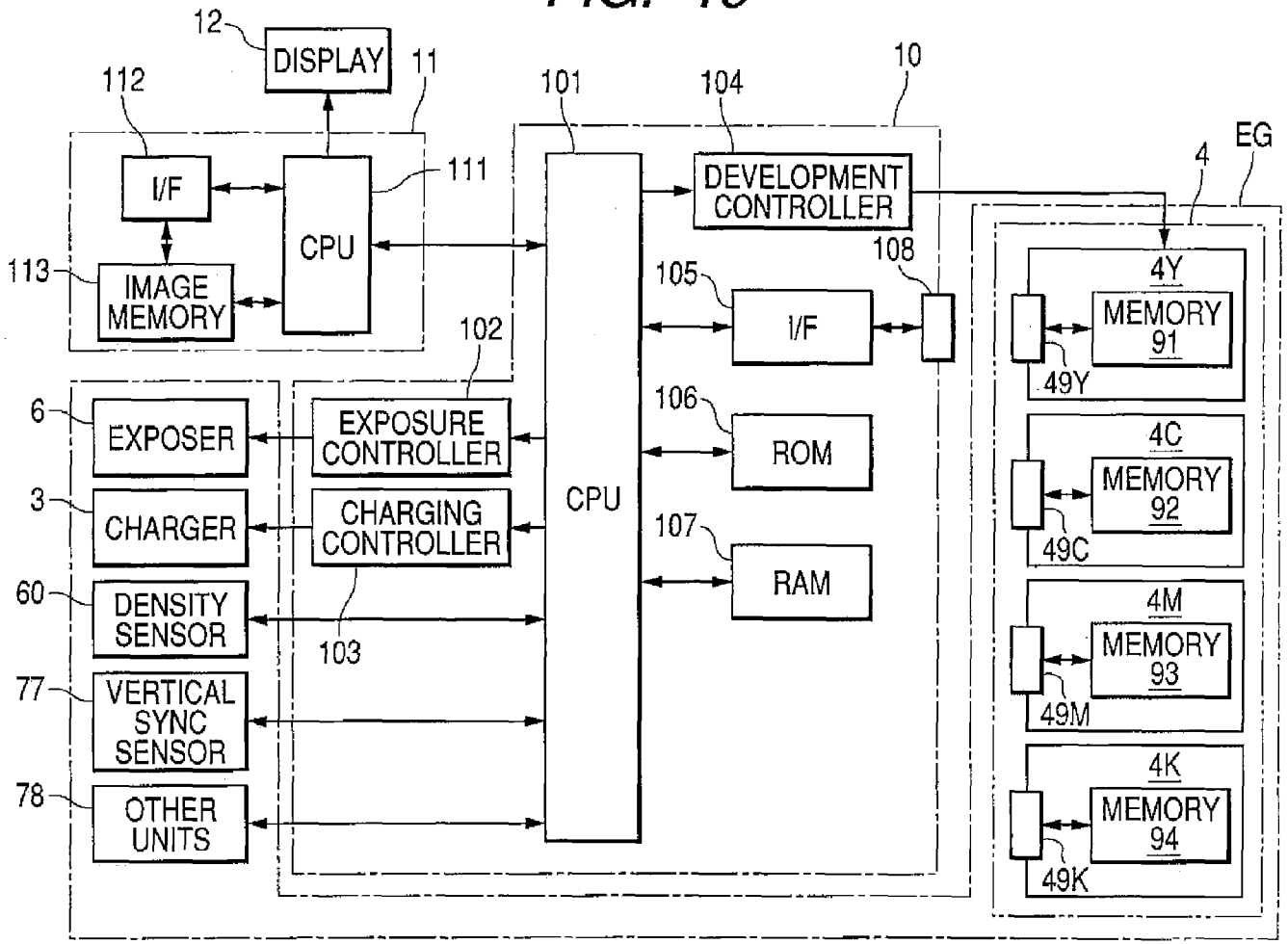
FIG. 19 is a block diagram showing an electric configuration of the image forming apparatus of FIG. 18.
Figure 20:
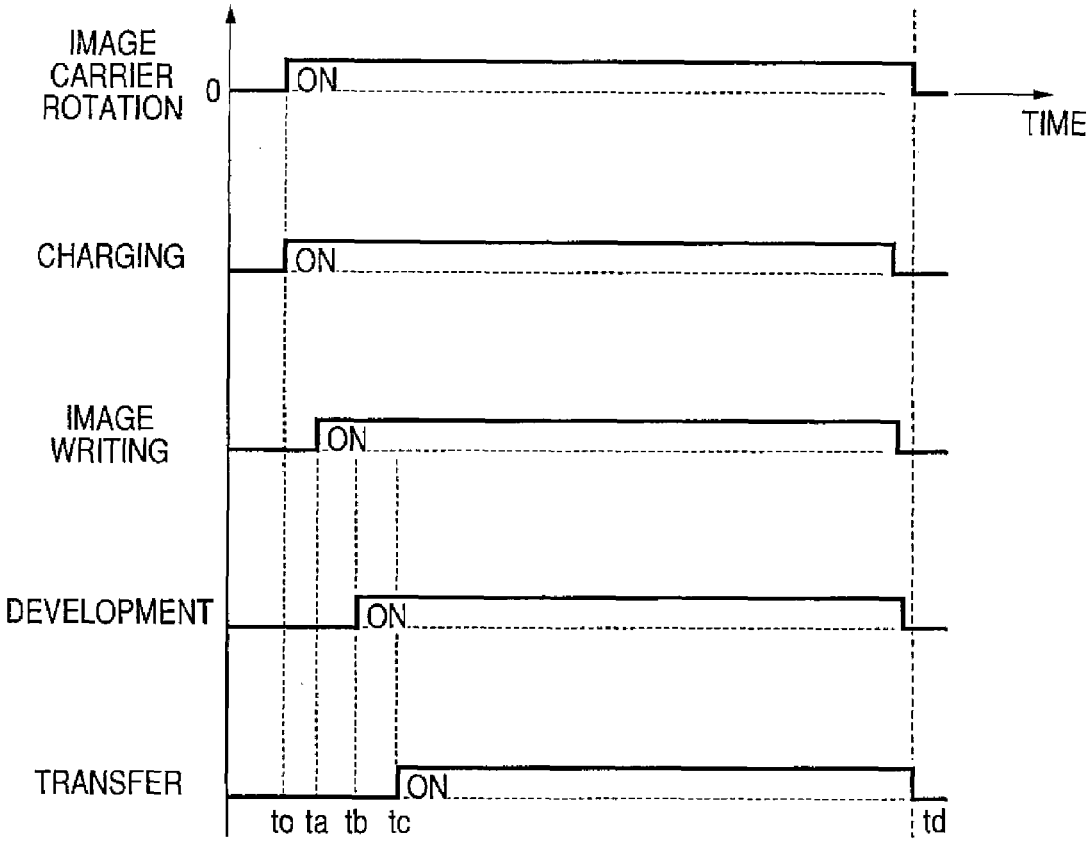
FIG. 20 is a time chart for explaining generation of image quality degradation in a monochromatic printer.

FIGS. 18 and 19 show a third example of an image forming apparatus incorporating the configuration of any one of the above embodiments. This image forming apparatus forms a full color image by overlaying toners of four colors of yellow (Y), cyan (C), magenta (M), and black (K), or alternatively forms a monochromatic image using a toner of black (K) solely.

In response to an image formation request from a user, an image signal is provided to a main controller 11 from an external unit such as a host computer. At that time, an instruction signal is transmitted from the main controller 11 to an engine controller 10. In response to this instruction signal, the engine controller 10 controls various subsections of an engine section EG, so that an image corresponding to the image signal is formed on a sheet S (recording medium).

In the engine section EG, an image carrier 2 is provided in a manner permitting the rotation in the direction indicated by an arrow D1. Further, a charger 3, a rotary developer 4, and a cleaner 5 are arranged around the image carrier 2 along the direction of rotation D1. A charging bias is applied to the charger 3 from a charging controller 103, so as to charge the outer circumferential surface of the image carrier 2 into a predetermined surface potential.

A light beam L is emitted from the exposer 6 onto the outer circumferential surface of the image carrier 2 charged by the charger 3. In response to a control instruction provided from the exposure controller 102, the exposer 6 emits the light beam L onto the image carrier 2, so as to form an electrostatic latent image corresponding to the image signal. The exposer 6 comprises appropriate optical components such as a lens and a mirror. The exposer 6 may have such configuration that the image carrier is scanned by the multi-beam scanning method described above.

An exposer 6 comprises a scanner motor composed of a DC motor, so that an optical element such as a rotary polygonal mirror is driven. These charger 3, rotary developer 4, and exposer 6 are configured to be replaceable permitting a fluctuation service. As such, in the exposer 6, an image writer is constructed from an optical scanning system.

When an image signal is provided from an external unit such as a host computer, through an interface, to the controller of the main controller 11, the CPU of the engine controller 10 outputs a control signal corresponding to the image signal to an exposure controller 102 at a predetermined timing. In response to this control signal, a light beam L is emitted from the exposer 6 onto the image carrier 2, so that an electrostatic latent image corresponding to the image signal is formed on the image carrier 2.

The electrostatic latent image formed as described above is toner-developed by the rotary developer 4 which comprises: a support frame 40 arranged in a manner permitting the rotation around the center of the shaft; and a rotary driver not shown. The rotary developer 4 further comprises a developer 4Y for yellow, a developer 4C for cyan, a developer 4M for magenta, and a developer 4K for black, each of which is removable from the support frame 40 and which contains a toner of the corresponding color. These developers 4Y, 4C, 4M, and 4K are arranged in the form of a replaceable toner cartridge.

The rotary developer 4 is driven and turned in response to the control instruction from the development controller 104. Further, these developers 4Y, 4C, 4M, and 4K are selectively positioned at a predetermined development position opposite the image carrier 2, so as to impart toner of the selected color onto the surface of the image carrier 2. As a result, the electrostatic latent image on the image carrier 2 is converted into a visible image of the selected color.

Further, in the rotary developer 4, prior to the image formation in the image formation region, an engine controller 10 forms a patch image of each color. In this patch image generation, a patch (Vdc patch) of a solid image is solely generated, or alternatively a patch of the solid image and a fine line patch (E patch) are generated. The fine line patch is formed by generating a patch image for one line but forming no image for the next ten lines in the secondary scanning direction. This is called a "1-on 10-off" scheme. Further, the main controller 11 forms a gradation patch image for determining a density adjustment pattern. The gradation patch is formed on the image carrier 2 in a single color or in an overlay of a plurality of colors.

A density sensor 60 (patch sensor) is provided for detecting the density of the patch image generated as described here. The density information of the patch image based on the signal from this sensor is stored in a storage. As such, when the density inhomogeneity in the patch image is detected in advance, the occurrence timing and the occurrence time of density inhomogeneity can be stored in the storage.

When the exposure value is controlled on the basis of this density information of the patch image, image formation is achieved without density inhomogeneity. Although the description has been omitted, the formation of a patch image, the detection of its density, the storing of this information in a storage, and the exposure value control on the basis of the density information of the patch image are performed also in the image forming apparatuses of FIGS. 16 and 17.

In the image forming apparatus, a development roller 44 provided in a developer (developer 4Y for yellow in the example of FIG. 18) positioned at the development position is arranged in contact with the image carrier 2, or alternatively arranged opposite the image carrier 2 with a predetermined gap. The development roller 44 serves as a toner carrier for carrying toner charged by friction, on the surface thereof. Then, as the development roller 44 rotates, the toner is transported to the position opposite the image carrier 2 on the surface of which an electrostatic latent image is formed.

A development bias composed of the superposition of a DC voltage and an AC voltage is applied from the development controller 104 to the development roller 44. This development bias causes the toner carried on the development roller 44 to adhere partly to various portions of the surface of the image carrier 2 depending on their surface potential. As a result, the electrostatic latent image on the image carrier 2 is converted into a visible toner image of the corresponding toner color.

The toner image developed in the developer 4 as described here is primary-transferred onto an intermediate transfer belt 71 of a transferer 7 in a primary transfer region TR1. The transferer 7 comprises: the intermediate transfer belt 71 stretched over a plurality of rollers 72 to 75; and a driver (not shown) for driving and rotating the roller 73 so as to cause the intermediate transfer belt 71 to circulate in a predetermined direction of rotation D2. Further, a secondary transfer roller 78 capable of moving between a position in contact with the surface of the intermediate transfer belt 71 and a position out of contact therewith by an electromagnetic clutch (not shown) is provided in a position opposite the roller 73 with the intermediate transfer belt 71 therebetween.

When a color image is to be transferred to a sheet S (recording medium), a toner image of each color formed on the image carrier 2 is first overlaid on the intermediate transfer belt 71, so that a color image is formed. Then, the color image is secondary-transferred to the sheet S extracted from a cassette 8 and transported to a secondary transfer region TR2 between the intermediate transfer belt 71 and the secondary transfer roller 78. The sheet S on which the color image has been formed is transported through a fuser 9 to a paper ejection tray provided in the upper surface portion of the apparatus main body.

In the image carrier 2 after the primary transfer of the toner image to the intermediate transfer belt 71, the surface potential is reset by a static electricity remover (not shown). Then, after the toner remaining on the surface of the image carrier 2 is removed by the cleaner 5, the surface of the image carrier 2 is re-charged by the charger 3. The toner removed by the cleaner 5 is collected into a waste toner tank (not shown).

Further, a cleaner 76, the density sensor 60, and a vertical synchronization sensor 77 are arranged in the vicinity of the roller 75. The cleaner 76 is capable of moving between a position in contact with the roller 75 and a position out of contact therewith by an electromagnetic clutch (not shown). When moved to the roller 75 side, a blade of the cleaner 76 contacts with the surface of the intermediate transfer belt 71 stretched over the roller 75, so as to remove the toner remaining on the outer circumferential surface of the intermediate transfer belt 71 after the secondary transfer. The toner removed by the blade of the cleaner 76 is collected into the waste toner tank.

The vertical synchronization sensor 77 is a sensor for detecting the reference position for the intermediate transfer belt 71, and for acquiring a synchronization signal outputted in association with the rotary drive of the intermediate transfer belt 71, that is, a vertical synchronization signal Vsync. In this apparatus, in order that the operation timings of various sections are synchronized, and that the toner images of various colors are overlaid precisely, the operation in the various sections is controlled on the basis of this vertical synchronization signal Vsync. Further, the density sensor 60 is arranged opposite the surface of the intermediate transfer belt 71, and measures in a density control process the optical density of a patch image formed on the outer circumferential surface of the intermediate transfer belt 71.

As shown in FIG. 19, each developer (toner cartridge) 4Y, 4C, 4M, or 4K is provided with one of memories 91 to 94 for storing data concerning the production lot, the usage history, the remaining toner amount, or the like of the developer 4. Each developer 4Y, 4C, 4M, or 4K is provided with a connector 49Y, 49C, 49M, or 49K.

Then, depending on the necessity, these connectors 49Y, 49C, 49M, and 49K are selectively connected to a connector 108 provided in the main body. As such, data is transmitted between a CPU 101 of the engine controller 10 and each of the memories 91-94 via an interface 105, so that various information concerning the consumable items in the developer (toner cartridge) is managed.

In this embodiment, the connector 108 of the main body is mechanically engaged with a connector 49K of each developer, so that data communication is performed. However, the data communication may be performed in a non-contacting manner such as wireless communications. Each of the memories 91 to 94 for storing the data specific to each developer 4Y, 4C, 4M, or 4K is composed preferably of a nonvolatile memory capable of retaining the data even when the apparatus is deactivated or the developer is removed from the main body.

Further, this image forming apparatus comprises a displaying 12 as shown in FIG. 19. In response to a control instruction provided from a CPU 111 in case of need, the displaying 12 displays a predetermined message, so as to inform the user of the necessary information. For example, in the case of the occurrence of an accident such as a failure in the apparatus or a paper sheet jam, a message is displayed so that the accident is informed to the user. Further, in the case of an abnormal state in the scanner motor or the like, a serviceman call is displayed.

The displaying 12 may be composed of a display unit such as a liquid crystal display. Instead, a warning lamp may be used that turns ON or OFF depending on the need. Further, in addition to the visual method of informing the user by a displayed message, an acoustic warning unit may be provided that uses a voice message recorded in advance or uses a buzzer. Furthermore, these methods may be used in combination.

The main controller 11 comprises an image memory 113 for storing an image provided from an external unit such as a host computer via an interface 112. Numeral 106 indicates a ROM for storing a calculation program executed on the CPU 101 and control data used in the control of the engine section EG. Numeral 107 indicates a nonvolatile RAM for storing temporarily the calculation result in the CPU 101 and other data. This memory may be composed of an FRAM (ferroelectric random access memory).

The RAM 107 stores: the life management information of replaceable units such as the toner cartridges; and various adjustment information such as density adjustment information. Further, the RAM 107 stores the vibration occurrence timings in the apparatus, that is, the timings of ON and OFF of the activation signals for the developer and the transferer as described in FIG. 1. The RAM 107 further stores the characteristics of the circumferential speed fluctuation in the image carrier 2 as described in FIG. 5A. In short, the RAM 107 serves as a storage for storing in advance the information concerning the occurrence of quality degrading factors in the image formation.

An exposure controller 102 outputs a signal for stopping the exposure operation to the exposer 6 of the scanning optical system, during the occurrence of vibrations in synchronization with the sequence. Further, at the same timing as the normal exposure, the exposure controller 102 performs scanning and exposure onto the scanning lines lacking exposure, as described in FIGS. 2A to 2D. Further, the exposure controller 102 controls the light emission value of the exposer 6, such that the light emission rate follows the characteristics of the circumferential speed fluctuation as described in FIG. 5B. In short, the exposure controller 102 controls the light emission rate of the image writer so as to suppress the printing quality degrading factors. Further, the exposure controller 102 sets the light emission timing of the image writer so as to suppress the printing quality degrading factors.

A charging controller 103 controls the charger 3. The CPU 101 receives the signals from the density sensor 60 and the vertical synchronization sensor 77. Further, the CPU 101 outputs drive signals for other units 78 such as the cleaning blade.

The invention has been described with reference to the embodiments of image forming apparatuses using an image writing head provided with organic EL light emitters or an image writer using a scanning optical system. However, the present invention is not limited to these, and various modifications are possible.

What is claimed is:

1. An image forming apparatus comprising:

an image carrier, configured to rotate in a first direction;

an image writer, adapted to irradiate the image carrier to form an electrostatic latent image thereon;

a storage, which stores information regarding a factor disturbing the formation of the latent image in advance;

a controller, which controls the irradiation of the image writer so as to eliminate the disturbing factor, based on the information stored in the storage;

a developer, which develops the latent image as a visible toner image; and a density sensor, which detects a density change in the toner image, wherein the disturbing information is obtained from the density change.

2. An image forming apparatus comprising:

an image carrier, configured to rotate in a first direction;

an image writer, adapted to irradiate the image carrier to form an electrostatic latent image thereon;

a storage, which stores information regarding a factor disturbing the formation of the latent image in advance, wherein the disturbing factor is generated synchronously with an operation sequence of the image formation apparatus and in accordance with vibrations in the apparatus; and a controller, which controls the irradiation of the image writer so as to eliminate the disturbing factor, based on the information stored in the storage, wherein the controller controls a timing at which the formation of the latent image is performed, when the vibrations are generated, and wherein the controller does not perform the formation of the latent image for a first part of the image carrier corresponding to a first timing when the vibrations are generated, and performs a subsequent formation of the latent image for both of the first part of the image carrier and a second part of the image carrier subsequent to the first part.

3. An image forming apparatus comprising:

an image carrier, configured to rotate in a first direction;

an image writer, adapted to irradiate the image carrier to form an electrostatic latent image thereon;

a storage, which stores information regarding a factor disturbing the formation of the latent image in advance, wherein the disturbing factor is generated synchronously with an operation sequence of the image formation apparatus and in accordance with fluctuations of a circumferential speed of the rotation of the image carrier; and a controller, which controls the irradiation of the image writer so as to eliminate the disturbing factor, based on the information stored in the storage, wherein the controller controls an exposure amount for a part where the latent image is formed at a timing when the circumferential speed fluctuates.

4. The image forming apparatus as set forth in claim 3, wherein the controller increases the exposure amount when the circumferential speed increases, and decreases the exposure amount when the circumferential speed decreases.

5. An, image forming apparatus comprising:

an image carrier, configured to rotate in a first direction;

an image writer, adapted to irradiate the image carrier to form an electrostatic latent image thereon;

a storage, which stores information regarding a factor disturbing the formation of the latent image in advance; and a controller, which controls the irradiation of the image writer so as to eliminate the disturbing factor, based on the information stored in the storage, wherein the image writer is a line head in which a plurality of light emitter arrays are arranged in the first direction, wherein each of the light emitter arrays includes a plurality of light emitters arrayed in a second direction perpendicular to the first direction, and wherein each of the light emitters is an organic electro luminescence type element.

6. The image forming apparatus as set forth in claim 5, wherein the image writer includes an optics for scanning a light beam.

7. The image forming apparatus as set forth in claim 5, wherein:

the image writer simultaneously performs the formation of the latent image for a plurality of linear regions arrayed in the first direction; and each of the linear regions extends in a second direction perpendicular to the first direction.

8. The image forming apparatus as set forth in claim 5, wherein a plurality of image formation units are arranged in a direction that a recording medium is transported; and each of the image formation units comprises the image carrier and the image writer.

9. The image forming apparatus as set forth in claim 5, further comprising a plurality of developers, each of which is subsequently opposed to the image carrier to supply one color of toner onto the image carrier to make the latent image as a visible toner image.

10. The image forming apparatus as set forth in claim 9, further comprising a transferee, which transfers the toner image from the image carrier to a transferring member.

11. An image forming method comprising steps of:

providing an image carrier configured to rotate in a first direction;

providing an image writer, adapted to irradiate the image carrier to form an electrostatic latent image thereon;

storing information regarding a factor disturbing the formation of the latent image in a storage in advance;

controlling the irradiation of the image writer so as to eliminate the disturbing factor, based on the information stored in the storage;

developing the latent image as a visible toner image;

detecting a density change in the toner image; and obtaining the disturbing information from the density change.

12. An image forming method comprising steps of:

providing an image carrier configured to rotate in a first direction;

providing an image writer, adapted to irradiate the image carrier to form an electrostatic latent image thereon;

storing information regarding a factor disturbing the formation of the latent image in a storage in advance, wherein the disturbing factor is generated synchronously with an operation sequence of the image formation apparatus and in accordance with vibrations in the apparatus; and controlling the irradiation of the image writer so as to eliminate the disturbing factor, based on the information stored in the storage, wherein a timing at which the formation of the latent image is performed is controlled, when the vibrations are generated, and wherein the formation of the latent image is not performed for a first part of the image carrier corresponding to a first timing when the vibrations are generated, and a subsequent formation of the latent image is performed for both of the first part of the image carrier and a second part of the image carrier subsequent to the first part.

13. An image forming method comprising steps of:

providing an image carrier configured to rotate in a first direction;

providing an image writer, adapted to irradiate the image carrier to form an electrostatic latent image thereon;

storing information regarding a factor disturbing the formation of the latent image in a storage in advance, wherein the disturbing factor is generated synchronously with an operation sequence of the image formation apparatus and in accordance with fluctuations of a circumferential speed of the rotation of the image carrier; and controlling the irradiation of the image writer so as to eliminate the disturbing factor, based on the information stored in the storage, wherein an exposure amount for a part where the latent image is formed is controlled at a timing when the circumferential speed fluctuates.

14. The image forming method as set forth in claim 13, wherein the exposure amount is increased when the circumferential speed increases, and the exposure amount is decreased when the circumferential speed decreases.

* * * * *